US007099603B2

(12) United States Patent
Kimura et al.

(10) Patent No.: US 7,099,603 B2
(45) Date of Patent: Aug. 29, 2006

(54) IMAGE FORMING APPARATUS HAVING A POST-PROCESSING APPARATUS WITH A CONTROLLER FOR CONTROLLING CONVEYANCE OF DOUBLE-SIDED SHEETS

(75) Inventors: Kuniyasu Kimura, Ibaraki (JP); Takayuki Fujii, Tokyo (JP); Yasuo Fukatsu, Chiba (JP); Toshiyuki Miyake, Ibaraki (JP)

(73) Assignee: Canon Kabushiki Kaisha, (JP)

( * ) Notice: Subject to any disclaimer, the term of this patent is extended or adjusted under 35 U.S.C. 154(b) by 0 days.

(21) Appl. No.: 10/949,113

(22) Filed: Sep. 24, 2004

(65) Prior Publication Data

US 2005/0084278 A1 Apr. 21, 2005

(30) Foreign Application Priority Data

Sep. 26, 2003 (JP) ..... 2003-336032

(51) Int. Cl.
*G03G 21/00* (2006.01)

(52) U.S. Cl. ..... 399/82; 399/401

(58) Field of Classification Search ..... 399/410, 399/82, 401

See application file for complete search history.

(56) References Cited

U.S. PATENT DOCUMENTS 6,353,727 B1 * 3/2002 Muraoka et al. ..... 399/410
6,381,442 B1 * 4/2002 Okitsu et al. ..... 399/405
6,757,516 B1 * 6/2004 Miura ..... 399/401

FOREIGN PATENT DOCUMENTS

JP 11-130328 A 5/1999
JP 2001-97631 A 4/2001

* cited by examiner

*Primary Examiner*—Quana Grainger
(74) *Attorney, Agent, or Firm*—Rossi, Kimms & McDowell, LLP

(57) ABSTRACT

An image forming apparatus, which realizes a buffering function which enables post-processing without decreasing the productivity and increasing the size. At least one image is formed on a sheet. A double-sided sheet conveying path is provided, which the sheet passes when being conveyed back to the image forming unit again to form an image on an opposite side surface of the sheet after an image is formed on one side surface of the sheet. A retaining member is provided on the double-sided sheet conveying path to retain the sheet on the double-sided sheet conveying path. A post-processing device carries out post-processing on sheets on which images have been formed by the image forming unit. A CPU circuit section, which controls conveyance of the sheet, provides control to convey the sheet on which the at least one image has been formed by the image forming unit to the double-sided sheet conveying path, cause the retaining member to temporarily retain the sheet on the double-sided sheet conveying path, and then convey the sheet to the post-processing device.

5 Claims, 24 Drawing Sheets

IMAGE FORMING APPARATUS HAVING A POST-PROCESSING APPARATUS WITH A CONTROLLER FOR CONTROLLING CONVEYANCE OF DOUBLE-SIDED SHEETS

BACKGROUND OF THE INVENTION

1. Field of the Invention

The present invention relates to an image forming apparatus such as a copying machine and a laser beam printer, and an image forming method.

2. Description of the Related Art

There has been known an image forming apparatus having a post-processing apparatus connected to a sheet discharge opening of the image forming apparatus to carry out various types of post-processing including stapling, punching, folding, and book binding for sheets on which the image forming apparatus has completed image formation.

When the post-processing apparatus is made to carry out the post-processing, it is necessary to keep long enough the intervals which are constant and at which sheets are discharged from a main body of the image forming apparatus, or to temporarily pool or buffer the discharged sheets on a stage prior to a post-processing section of the post processing apparatus (a buffering function), so as not to disturb or hinder the post-processing carried out by the post-processing section. Among inexpensive image forming apparatuses with a low productivity, there is a type which is adapted to widen the intervals at which sheets are discharged, but many image forming apparatuses are generally provided with the buffering function so as to increase the productivity, as disclosed in Japanese Laid-Open Patent Publication (Kokai) No. H11-130328 and Japanese Laid-Open Publication (Kokai) No. 2001-097631.

However, if the main body of the image forming apparatus or the post-processing apparatus incorporates the buffering function, a space occupied by a buffering section, a drive mechanism used for the buffering section, and other component parts pose a problem that the main body of the image forming apparatus or the post-processing apparatus increases in size. This also leads to an increased cost.

SUMMARY OF THE INVENTION

It is an object of the present invention to provide an image forming apparatus and an image forming method that realize a buffering function which enables post-processing without decreasing the productivity and increasing the size.

To attain the above object, in a first aspect of the present invention, there is provided an image forming apparatus comprising an image forming unit that forms at least one image on a sheet, a double-sided sheet conveying path which the sheet passes when being conveyed back to the image forming unit again to form an image on an opposite side surface of the sheet after an image is formed on one side surface of the sheet, a retaining member that is provided on the double-sided sheet conveying path to retain the sheet on the double-sided sheet conveying path, a post-processing device that carries out post-processing on sheets on which images have been formed by the image forming unit, and a controller that controls conveyance of the sheet, wherein the controller provides control to convey the sheet on which the at least one image has been formed by the image forming unit to the double-sided sheet conveying path, cause the retaining member to temporarily retain the sheet on the double-sided sheet conveying path, and then convey the sheet to the post-processing device.

Preferably, the image forming apparatus comprises a conveying destination designating device that designates the double-sided sheet conveying path as a conveying destination of the sheet on which at least one image has been formed by the image forming unit when the post-processing device is carrying out post-processing, and designates the post-processing device as the conveying destination of the sheet on which at least one image has been formed by the image forming unit, when the post-processing device is not carrying out post-processing, and the controller provides control to convey the sheet on which at least one image has been formed by the image forming unit to the conveying destination designated by the conveying destination designating device.

Preferably, the controller provides control to repeats an operation for a first page to a last page of sheets on which images have been formed by the image forming unit, the operation comprising sequentially conveying the sheets on which images have been formed by the image forming unit to the double-sided sheet conveying path, causing the retaining member to retain a predetermined number of the sheets, and then conveying the retained sheets to the post-processing unit.

Preferably, the image forming apparatus comprises an image forming mode input device that inputs an image forming mode, and a retention determining device that determines whether the retaining member is to retain the sheet on which at least one image has been formed by the image forming unit, based on the input image forming mode.

More preferably, the retention determining device determines that the retaining member is to retain the sheet when the input image forming mode is a mode in which post-processing is carried out.

More preferably, the retention determining device determines that the retaining member is not to retain the sheet when the input image forming mode is a mode in which images are formed on opposite side surfaces of the sheet.

More preferably, the retention determining device determines that the retaining member is not to retain the sheet when a number of sheet bundles for which post-processing is carried out is one.

Preferably, the controller is operable when a paper jam occurs in the image forming apparatus while the sheet is retained on the double-sided sheet conveying path by the retaining member, to provide control to discharge the retained sheet, and then stop operation of the image forming apparatus.

Preferably, the controller is operable when a paper jam occurs in the image forming apparatus while the sheet is retained on the double-sided sheet conveying path by the retaining member, to provide control to stop operation of the image forming apparatus while allowing the sheet to be retained on the double-sided sheet conveying path, and discharge the sheet retained on the double-sided sheet conveying path when the controller restarts the operation of the image forming apparatus after the paper jam is removed.

Preferably, the controller is operable when a second sheet being conveyed to the post-processing device is jammed while a first sheet is retained on the double-sided sheet conveying path by the retaining member, to provide control to stop operation of the image forming apparatus while allowing the first sheet to be retained on the double-sided sheet conveying path, cause the image forming unit to form at least one image corresponding to the jammed second sheet on a third sheet when the operation of the image forming apparatus is restarted, and discharge the first sheet retained in the double-sided sheet conveying path after the third sheet on which at least one image has been formed by the image forming unit is discharged.

More preferably, when the controller stops the operation of the image forming apparatus while the sheet is retained on the double-sided sheet conveying path, the controller is operable when a cover which can come into contact with the sheet retained on the double-sided sheet conveying path is opened while the jammed sheet is removed, to provide control to issue an instruction requesting for removing the sheet retained in the double-sided sheet conveying path, cause the image forming unit to form at least one image corresponding to the removed sheet on a second sheet, and discharge the second sheet on which the at least one image has been formed.

Preferably, the retaining member retains one sheet or a plurality of sheets.

Also preferably, the controller retracts the sheet retained on the double-sided sheet conveying path by the retaining member, thereby conveying the sheet to the post-processing device.

Typically, the post-processing device binds a predetermined number of sheets on which images have been formed.

Also typically, the post-processing device discharges a bundle of a predetermined number of sheets on which images have been formed.

To attain the above object, in a second aspect of the present invention, there is provided an image forming method comprising an image forming step of causing an image forming unit to form at least one image on a sheet, a retaining step of causing a retaining member to retain the sheet on a double-sided sheet conveying path which the sheet passes when being conveyed back to the image forming unit again to form an image on an opposite side surface of the sheet after an image is formed on one side surface of the sheet, a post-processing step of causing a post-processing device to carry out post-processing on sheets on which images have been formed by the image forming unit, and a control step of controlling conveyance of the sheet, wherein in the control step, control is provided to convey the sheet on which at least one image has been formed by the image forming unit to the double-sided sheet conveying path, cause the retaining member to temporarily retain the sheet on the double-sided sheet conveying path in the retaining step, and then convey the sheet to the post-processing device.

The above and other objects, features and advantages of the invention will become more apparent from the following detailed description taken in conjunction with the accompanying drawings.

BRIEF DESCRIPTION OF THE DRAWINGS

FIGS. 3A to 3G are views useful in explaining conveyance of a sheet in a double-sided mode carried out by the image forming apparatus to form images on both sides of the sheet, in which:

FIG. 3A is a view showing a state where a sheet is inserted into a nip of a pair of inversion rollers;

FIG. 3B is a view showing a state where the sheet is guided to a double-sided sheet conveying path;

FIG. 3C is a view showing a state where the sheet is made to abut on a pair of registration rollers, and stops;

FIG. 3D is a view showing a state where a developer image is transferred onto an opposite side surface of the fed sheet;

FIG. 3E is a view showing a state where the sheet is discharged toward a finisher;

FIG. 3F is a view showing a state where a first sheet is discharged onto a bundle discharging belt; and FIG. 3G is a view showing a state where a second sheet is being discharged onto the bundle discharging belt;

FIGS. 7A and 7B are views showing soft keys arranged on a liquid crystal display section in FIG. 6, in which:

FIG. 7A is a view showing an initial screen; and

FIG. 7B is a view showing a menu option screen;

FIGS. 8A to 8H are views useful in explaining a buffering operation using the double-sided sheet conveying path, in which:

FIG. 8A is a view showing a state where a second sheet is being discharged to the finisher;

FIG. 8B is a view showing a state where a third sheet is discharged to the finisher;

FIG. 8C is a view showing a state where a fourth sheet to be contained in a second bundle is guided to a conveying path;

FIG. 8D is a view showing a state where the fourth sheet is being guided to the double-sided sheet conveying path;

FIG. 8E is a view showing a state where a fifth sheet is guided to the conveying path;

FIG. 8F is a view showing a state where the fifth sheet is being guided to the double-sided sheet conveying path;

FIG. 8G is a view showing a state where both the fourth and fifth sheets are being guided to the conveying path at the same time; and FIG. 8H is a view showing a state where a sixth sheet is being discharged to the finisher;

FIGS. 9A to 9E are views useful in explaining movements of sheets on the double-sided sheet conveying path, in which:

FIG. 9A is a view showing movements of sheets on the double-sided sheet conveying path corresponding in timing to a state intermediate between the states in FIGS. 8D and 8E;

FIG. 9B is a view showing movements of the sheets before a leading edge of a sheet B passes through a pair of conveying rollers, which corresponds in timing to the state appearing in FIG. 8F;

FIG. 9C is a view showing movements of the sheets after the leading edge of the sheet B has passed through the pair of conveying rollers, which corresponds in timing to the state appearing in FIG. 8F;

FIG. 9D is a view showing movements of the sheets when the leading edge of the sheet B has come into contact with a movable stopper, which corresponds in timing to the state appearing in FIG. 8F; and FIG. 9E is a view showing movements of the sheets on the double-sided sheet conveying path, which corresponds in timing to the state appearing in FIG. 8G;

FIGS. 14A to 14H are views showing a buffering operation using the double-sided sheet conveying path according to a second embodiment of the present invention, in which:

FIG. 14A is a view showing a state where a third sheet is being discharged to the finisher;

FIG. 14B is a view showing a state where a fourth sheet is discharged to the finisher;

FIG. 14C is a view showing a state where a fifth sheet is guided to the conveying path;

FIG. 14D is a view showing a state where the fifth sheet is being guided to the double-sided sheet conveying path;

FIG. 14E is a view showing a state where a sixth sheet is guided to the conveying path;

FIG. 14F is a view showing a state where the sixth sheet is being guided to the double-sided sheet conveying path;

FIG. 14G is a view showing a state where both the fifth and sixth sheets are guided to the conveying path at the same time; and FIG. 14H is a view showing a state where a seventh sheet is being guided to the double-sided sheet conveying path.

DETAILED DESCRIPTION OF THE PREFERRED EMBODIMENTS

The present invention will now be described in detail with reference to the drawings showing preferred embodiments thereof.

Figure 1:
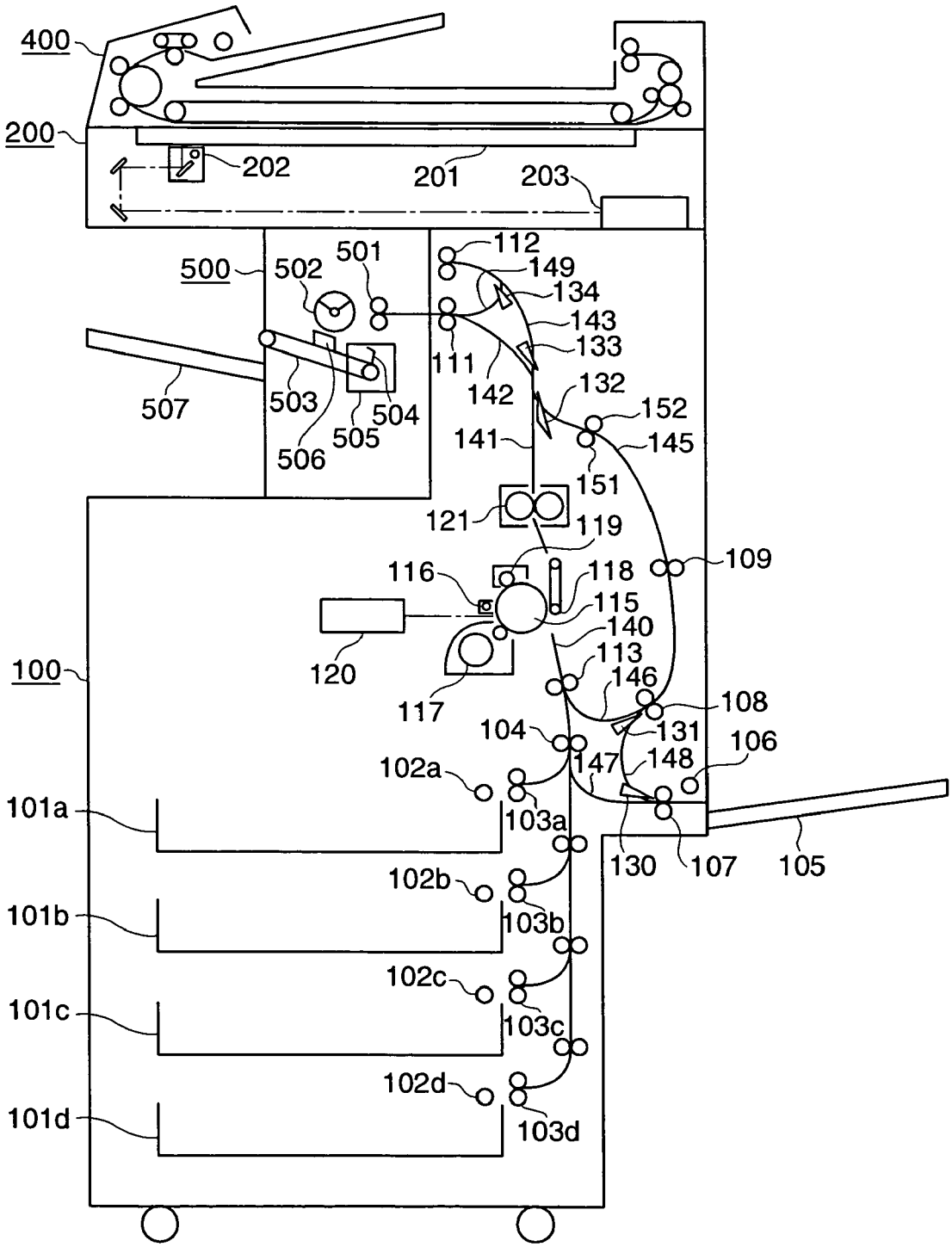
FIG. 1 is a cross sectional view schematically showing the construction of an image forming apparatus according to a first embodiment of the present invention.

FIG. 1 is a cross sectional view schematically showing the construction of an image forming apparatus according to a first embodiment of the present invention. This image forming apparatus is comprised of a main body thereof including a printer 100 and an image reader 200, and a finisher 500. An original feeder 400 is mounted on the image reader 200. Originals are set on an original tray with image-formed surfaces thereof facing upward. The original feeder 400 sequentially feeds the originals leftward as view in FIG. 1 one by one starting with a first page, and stops each original at a predetermined position on a platen glass 201. With the original in this state, a scanner unit 202 is caused to scan the original from the left to the right to read the same.

As the scanner unit 202 scans the original, a surface of the original to be read is illuminated by a lamp of the scanner 202, and reflected light from the original is guided to a lens via mirrors, and forms an image on an image pickup surface of an image sensor 203 after passing through the lens. The image sensor 203 optically reads the formed image and converts the read image into image data and outputs the image data. The image data output from the image sensor 203 is subjected to predetermined processing by an image sensor controller 281 (refer to FIGS. 8A to 8H) and then input as a vide signal to an exposure controller 120 in the printer 100.

Figure 2:
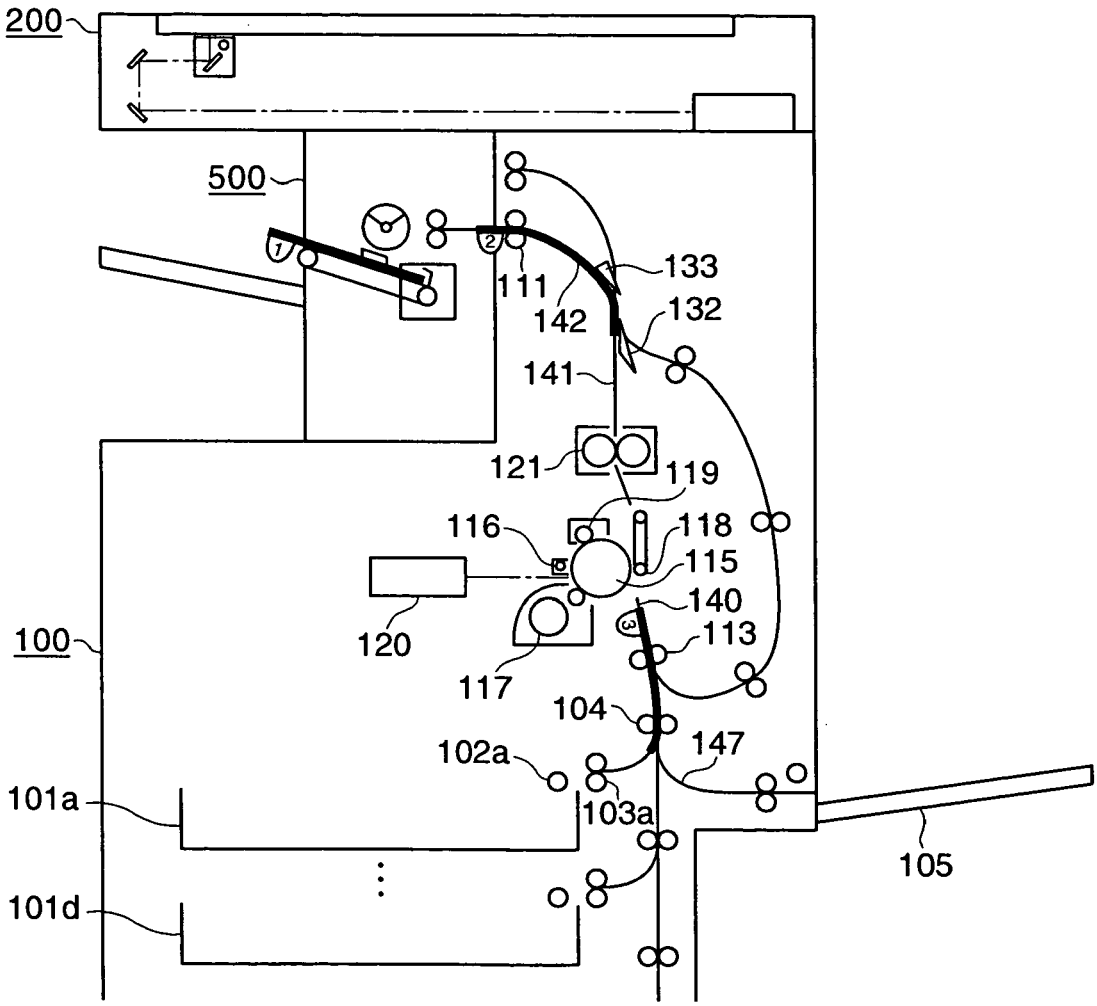
FIG. 2 is a view useful in explaining conveyance of a sheet in a single-sided mode carried out by the image forming apparatus in FIG. 1 to form an image only on one side surface of the sheet.

FIG. 2 is a view useful in explaining conveyance of a sheet in a single-sided mode carried out by the image forming apparatus in FIG. 1 to form an image only on one side surface of the sheet. The exposure controller 120 in the printer 100 modulates laser light based on the input video signal, and outputs the modulated laser light. The modulated laser light is irradiated upon a photosensitive drum 115 while the laser light is being scanned by a polygon mirror, not shown. Consequently, an electrostatic latent image is formed on the photosensitive drum 115 according to the scanning of the laser light. The electrostatic latent image on the photosensitive drum 115 is visualized as a developer image by supplying a developer from a developing device 117.

On the other hand, a sheet fed from one of cassettes 101*a* to 101*d* or *a* sheet fed from a manual feed tray 105 via a conveying path 147 temporarily stops with leading edge thereof brought into abutment with a pair of registration rollers 113, and is then conveyed to a gap between the photosensitive drum 115 and a transfer section 118 in timing synchronous with the start of irradiation of the laser light. The developer image formed on the photosensitive drum 115 is transferred onto the fed sheet by the transfer section 118. Skew of the sheet is corrected by the conveyance of the sheet being temporarily stopped with the leading edge thereof brought into abutment with the pair of registration rollers 113 as mentioned above.

Then, the sheet onto which the developer image has been transferred is conveyed to a fixing section 121, and the fixing section 121 then heats and pressurizes the sheet, thereby fixing the developer image onto the sheet. The sheet which has left the fixing section 121 is guided to a conveying path 142 by a flapper 133. The sheet then passes through a pair of discharging rollers 111, and is discharged from the printer 100 toward a finisher 500 disposed outside. On this occasion, the sheet is discharged in a so-called face-down state where the surface with the image formed thereon faces downward. Therefore, if the image formation is sequentially carried out starting with a top or uppermost page, a sheet bundle of the discharged sheets has a correct page sequence. It should be noted that, as shown in FIG. 2, a numeral indicating a page number is attached to a front side surface of each sheet (numerals indicating pages "1", "2", "3" and so forth are attached respectively to front side surfaces of the sheets). These numerals are similarly attached in subsequent figures.

FIGS. 3A to 3G are views useful in explaining conveyance of a sheet in a double-sided mode carried out by the image forming apparatus to form images on both side surfaces of the sheet. Similarly to the single-sided mode, a sheet fed from one of the cassettes 101*a* to 101*d* or *a* sheet fed from the manual feed tray 105 (refer to FIG. 1) via the conveying path 147 (refer to FIG. 1), the leading edge thereof is brought into abutment with the pair of registration rollers 113, and the sheet is then conveyed to the gap between the photosensitive drum 115 and the transfer section 118. A developer image formed on the photosensitive drum 115 is transferred onto the fed sheet by the transfer section 118. Then, the sheet passes through the fixing section 121, whereby an image is formed on one side surface of the sheet. The flapper 133 is switched so that the sheet is guided from the conveying path 141 to a conveying path 143, and stops with the leading edge of the sheet inserted into a nip of a pair of inversion rollers 112 (refer to FIG. 3A). Then, the flapper 133 is switched again and the pair of inversion rollers 112 is reversely driven, so that the sheet is guided from the conveying path 143 to a double-sided sheet conveying path 145 (refer to FIG. 3B). Then, the sheet is guided to a conveying path 146 by a flapper 131 (refer to FIG. 1), and stops with the leading edge brought into abutment with the pair of registration rollers 113 (refer to FIG. 3C). By this time, the sheet has been turned over.

Then, the sheet is fed again to the gap between the photosensitive drum 115 and the transfer section 118, and a developer image formed on the photosensitive drum 115 is transferred onto the other side surface of the fed sheet by the transfer section 118 (refer to FIG. 3D) Then, the sheet passes through the fixing section 121, whereby the image is fixed on the other side surface of the sheet. Then, the flapper 133 is switched so that the sheet is guided from the conveying path 141 to the conveying path 142, to be discharged through the pair of discharging rollers 111 from the printer 100 toward the finisher 500 (refer to FIG. 3E).

On this occasion, the sheet is discharged with the side surface of the sheet subjected to image formation last (the first page surface) facing down. In this way, an image is first formed on the reverse side surface of the sheet to set the pages of the sheets discharged from the printer 100 to the finisher 500 in a proper sequence. Although in the present embodiment, in carrying out double-sided image formation on a plurality of sheets, image formation is carried out on the plurality (two in the present embodiment) of the sheet in parallel, alternatively the image formation may be completed on both the front and rear side surfaces of a first sheet, followed by carrying out image formation on a second sheet.

Figure 3B:
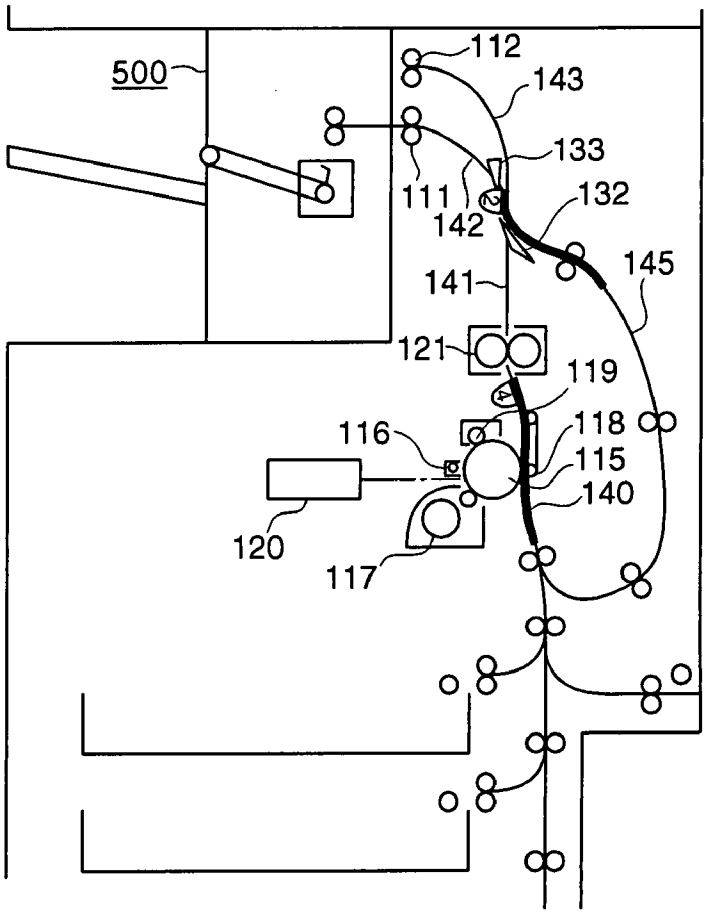
Figure 3A:
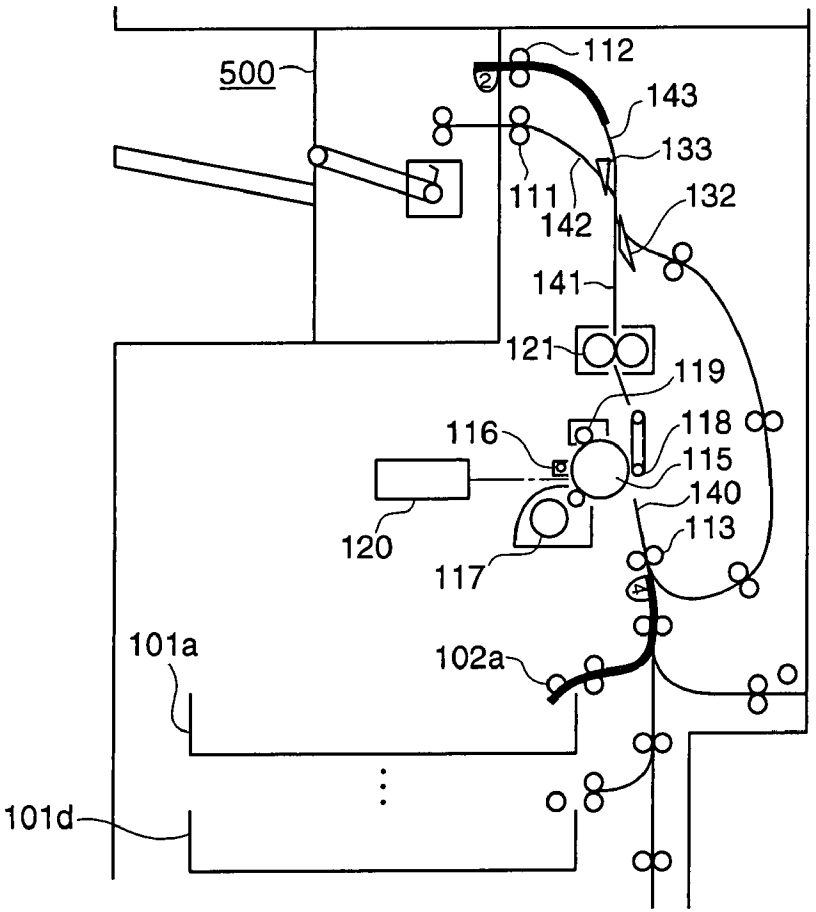
Figure 3D:
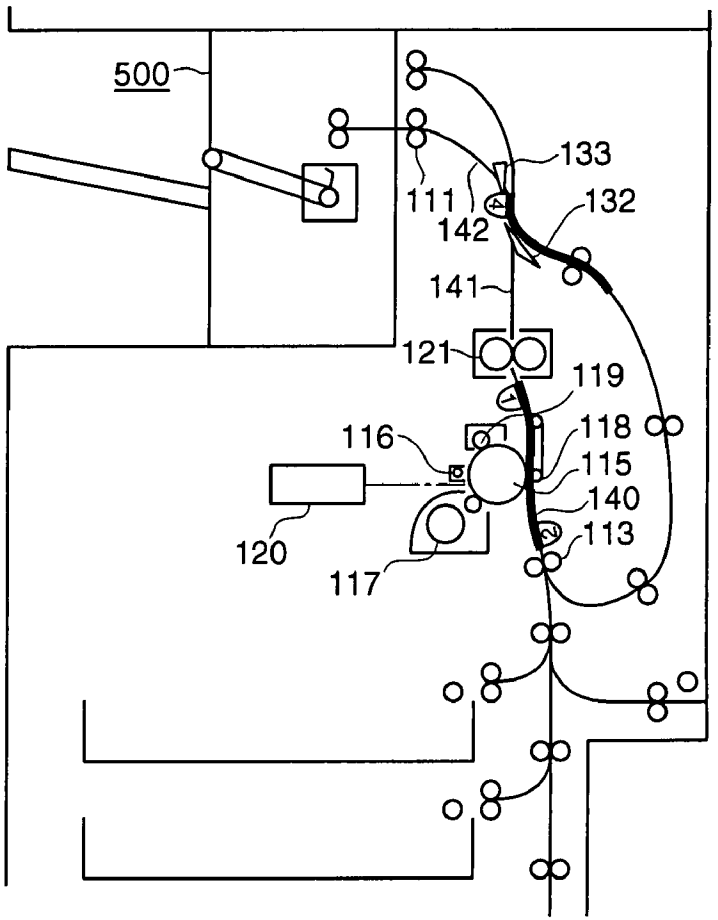
Figure 3C:
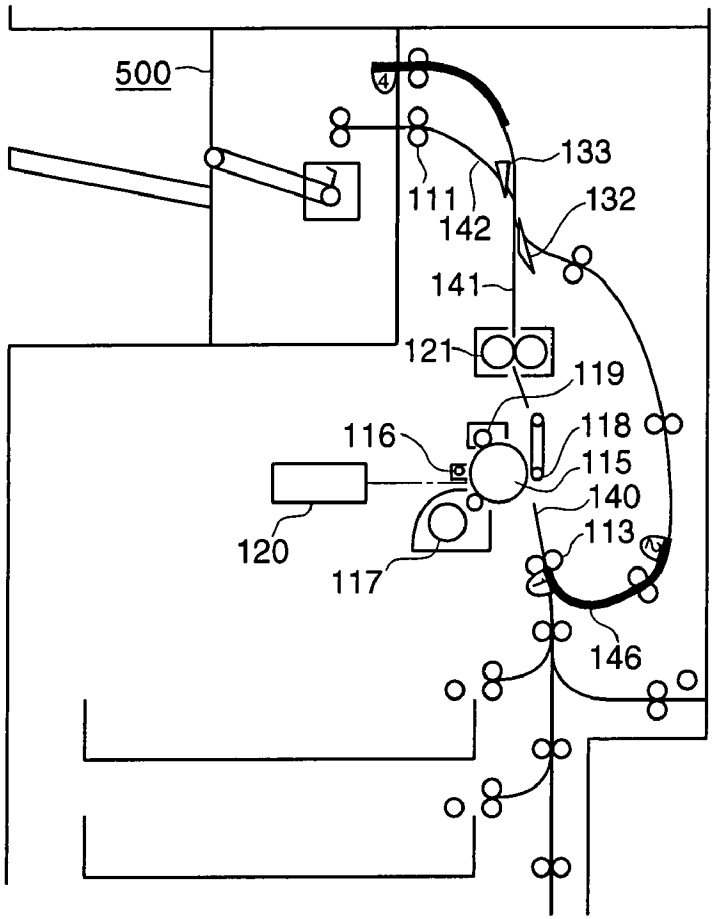
Figure 3F:
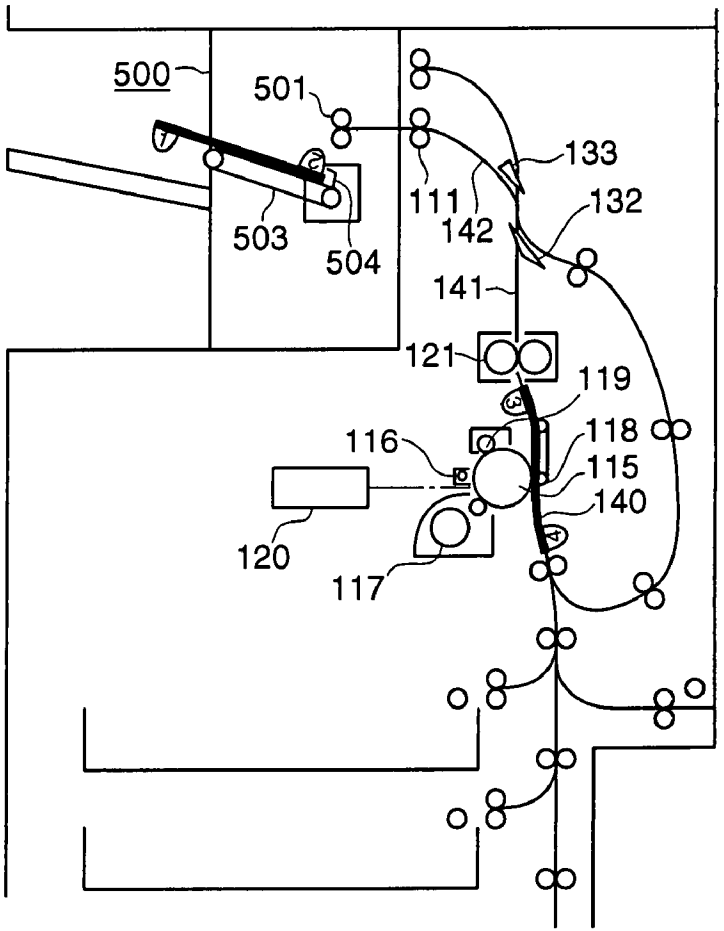
Figure 3E:
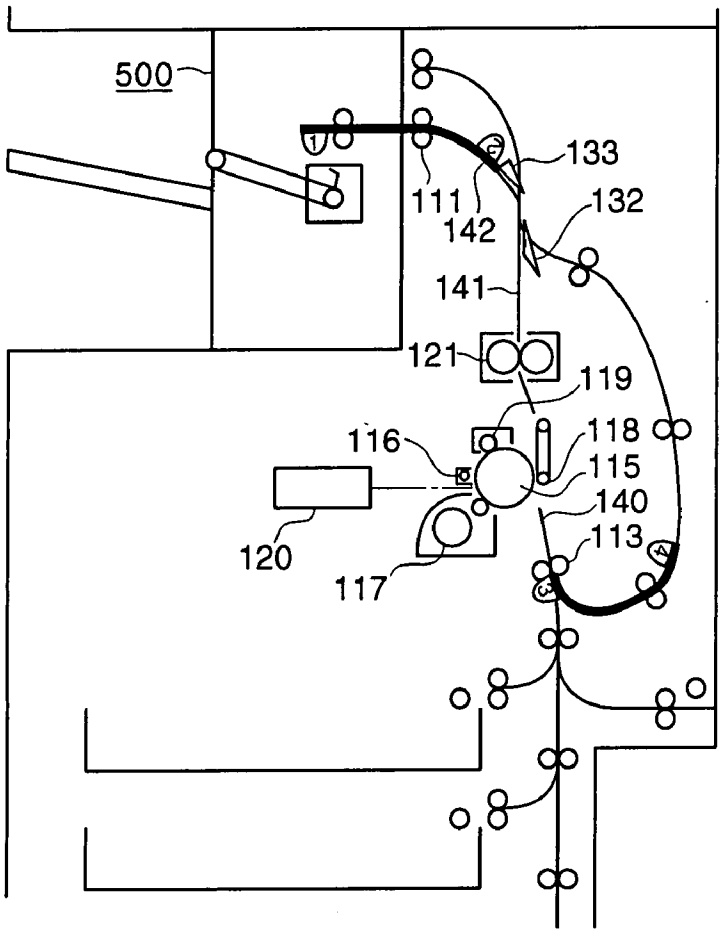
Figure 3G:
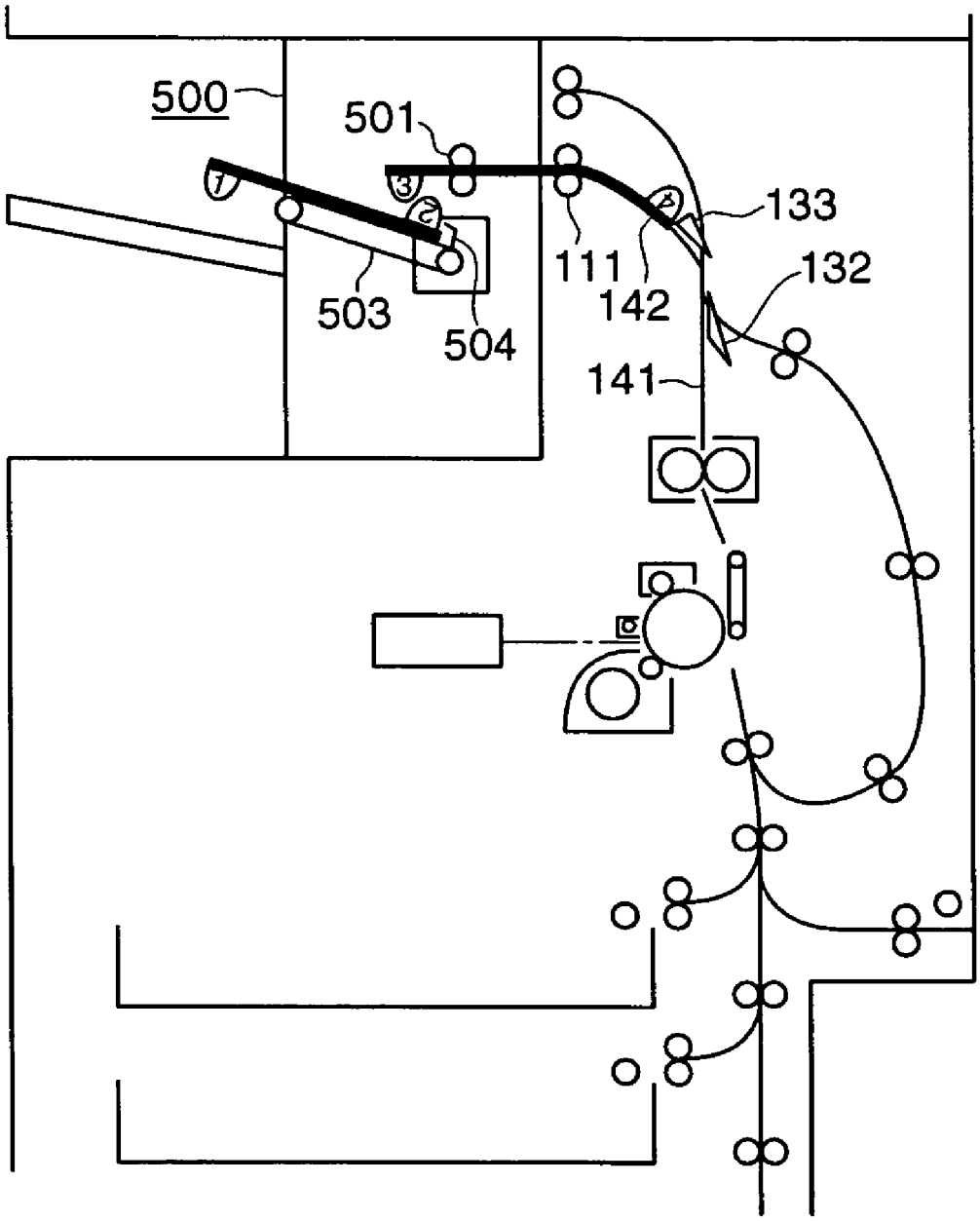

When a sheet discharged from the printer 100 is conveyed to the finisher 500, the sheet is discharged onto a bundle discharging belt 503 by a pair of discharging rollers 501 inside the finisher 500 (refer to FIGS. 3F and 3G). More specifically, an intermediate processing tray, not shown, is disposed in parallel with the bundle discharging belt 503 at a location several millimeters above the same and extending in a front/rear (nearer/farther) direction as viewed in FIGS. 3F and 3G, and the sheet is discharged onto the intermediate processing tray.

The discharged sheet falls by its own weight along the intermediate processing tray, which has a low friction and is inclined similarly to the bundle discharging belt 503 and the bundle discharging belt 503 toward a lower right direction as viewed in the figures. Then, a return roller 502 in the form of a fan (refer to FIG. 1) rotates counterclockwise so that a friction member provided on an arcuate periphery of the return roller 502 thus comes in contact with the sheet to promote downward sliding of the sheet in the lower right direction as viewed in the figures, until the edge of the sheet is thus brought into abutment with a stopper plate 504. Consequently, end edges of the sheets are aligned in the lengthwise direction (feeding direction) of the sheets.

In addition, the intermediate processing tray has a pair of aligning plates 506 (refer to FIG. 1) disposed on nearer and farther (front and rear) sides as viewed in the figures, and the aligning plates 506 are driven each time a sheet is discharged onto the intermediate processing tray, so that lateral edges of the sheets discharged onto the intermediate processing tray are aligned in the transverse (widthwise) direction of the sheets.

Figure 4:
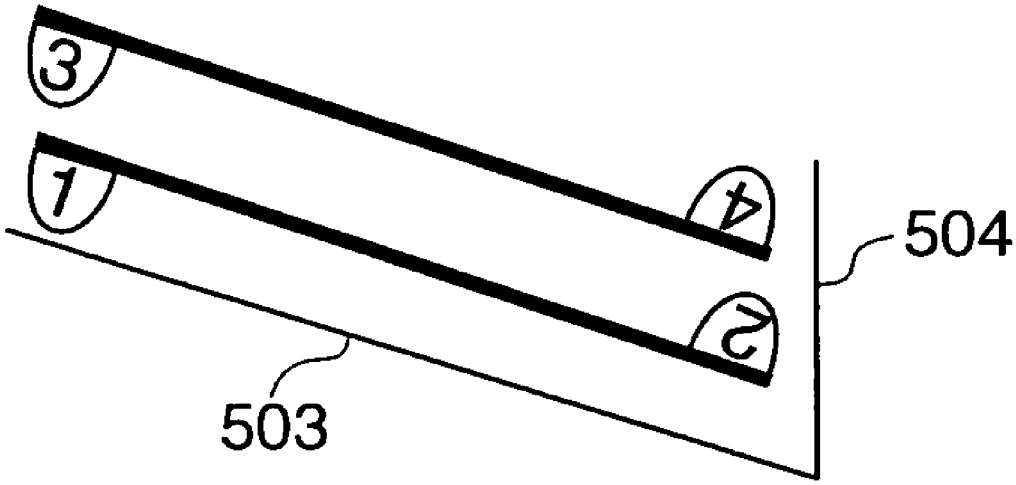
FIG. 4 is a view showing a stacked state of sheets discharged onto an intermediate processing tray of the finisher in FIG. 3G.

FIG. 4 is a view showing a stacked state of sheets discharged onto the intermediate processing tray of the finisher 500 in a double-sided mode. When sheets are discharged onto the intermediate processing tray and stacked thereon, the bundle discharging belt 503 is driven to discharge the stacked sheet bundle stacked onto a stack tray 507 (refer to FIG. 1). On this occasion, if stapling is set, sheets corresponding to one bundle to be stapled are discharged onto the intermediate processing tray, and the pair of aligning plates 506 (refer to FIG. 1) align edges of the sheets. Then, a stapler 505 (refer to FIG. 1) is driven to staple the sheet bundle, and the bundle discharging belt 503 discharges the stapled sheet bundle onto the stack tray 507. The stapler 505 is movable relative to the sheet bundle on the intermediate processing tray in the transverse (widthwise) direction thereof and can staple at any position in the nearer/farther (front/rear) direction.

Figure 5:
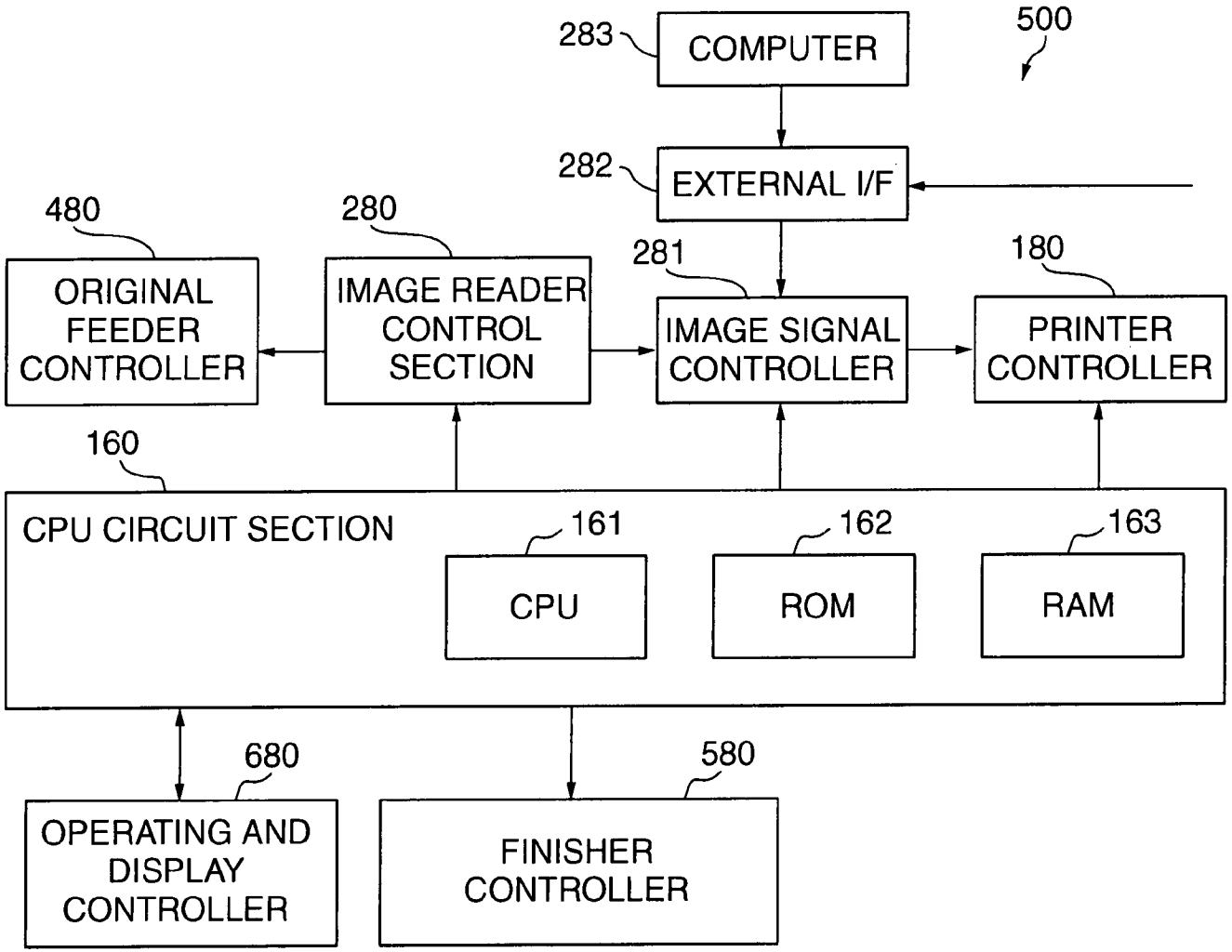
FIG. 5 is a block diagram schematically showing the construction of a controller (control section) that controls the overall image forming apparatus.

FIG. 5 is a block diagram schematically showing the construction of a controller (control section) that controls the overall image forming apparatus 100.

As shown in FIG. 5, the controller 500 is comprised of a CPU circuit section 160, an original feeder controller 480, an image reader control section 280, an image signal controller 281, a printer controller 180, an operating and display section controller 680, and a finisher controller 580. An external computer 283 is connected to the image signal controller 281 via an external interface (I/F) 282.

The CPU circuit section 160 is comprised of a CPU 161, a ROM 162, and a RAM 163, and the CPU 161 comprehensively controls various sections by executing control programs stored in the ROM 162. The RAM 163 temporarily stores control data, and is used as a work area for arithmetic processing when the CPU 161 executes the control programs.

The original feeder controller 480 controls the automatic original feeder 400 according to instructions from the CPU circuit section 160. The image reader control section 280 controls the scanner unit 202 (FIG. 1), the image sensor 203 (FIG. 1), and others, thereby transferring an analog image signal output from the image sensor 203 to the image signal controller 281.

The image signal controller 281 converts the analog image signal output from the image sensor 203 into a digital signal, and then carries out various processing on the digital signal, converts the processed digital signal into a video signal, and outputs the video signal to the printer controller 180. Further, the image signal controller 281 carries out various processing on a digital image signal input from the computer 283 via the external I/F 282, converts the processed digital image signal into a video signal, and outputs the video signal to the printer controller 180. The above operations of the image signal controller 281 are controlled by the CPU control circuit section 160.

The operating and display section controller 680 carries out information communications between an operating and display section 600 (refer to FIG. 6) and the CPU circuit section 160. As described later, the operating and display section 600 includes a plurality of keys used to set various functions relating to the image formation, a display section for displaying setting states. The operating and display section 600 outputs key signals corresponding to operations carried out on the respective keys to the CPU circuit section 160, and also displays information corresponding to signals supplied from the CPU circuit section 160 on the display section, based on these signals. The printer controller 180 drives the exposure controller 120 (FIG. 1) based on the input video signal.

Figure 6:
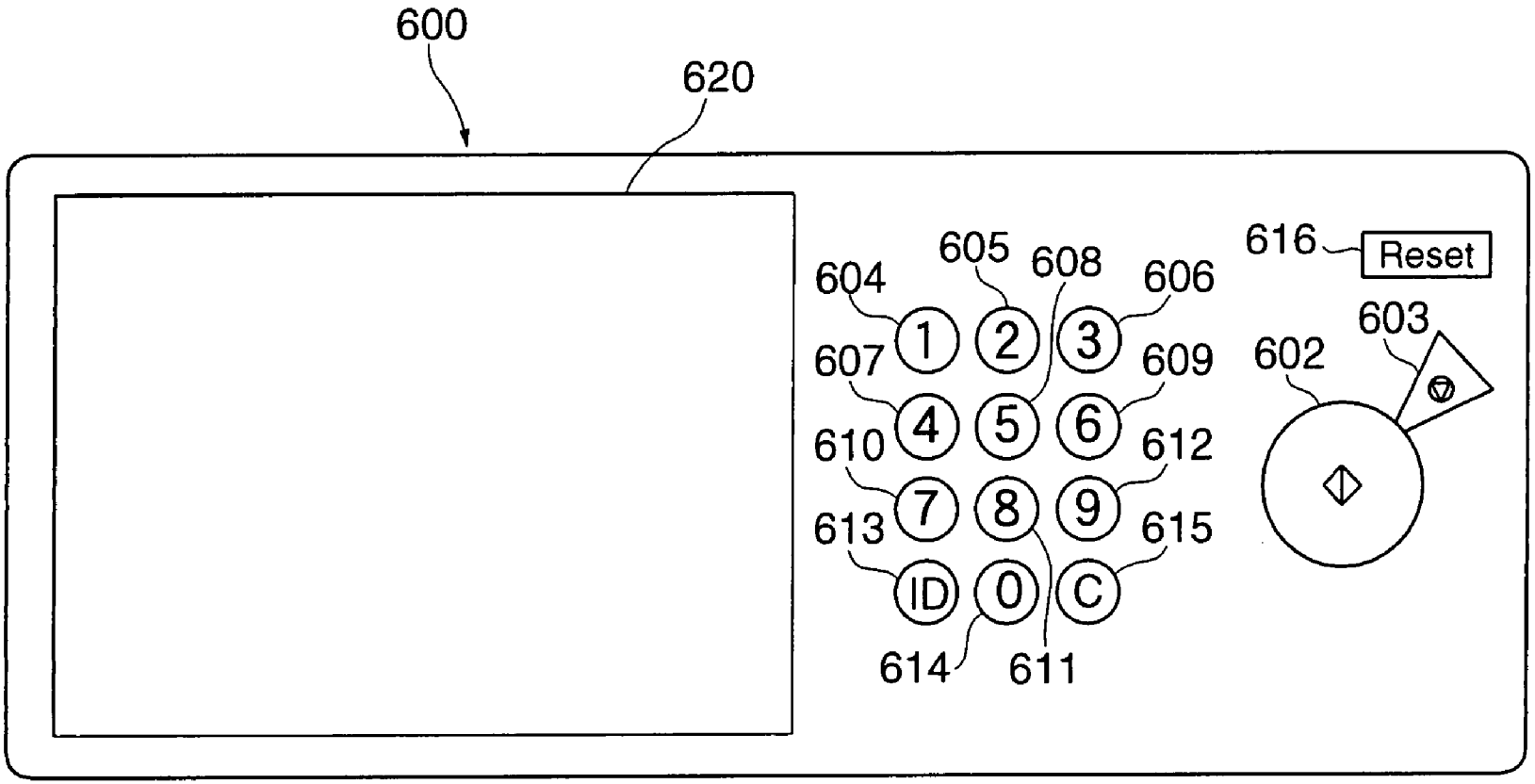
FIG. 6 is a view showing the appearance of an operating and display section of the image forming apparatus.

FIG. 6 is a view showing the appearance of the operating and display section 600 of the image forming apparatus.

As shown in FIG. 6, the operating and display section 600 has arranged thereon a start key 602 for starting an image forming operation, a stop key 603 for suspending an image forming operation, ten keys 604 to 612 and 614 for carrying out numeric settings and the like, an ID key 613, a clear key 615, and a reset key 616.

In addition, a liquid crystal display section 620 on which a touch panel is formed is disposed on a left hand portion of the operating and display section 600. Soft keys are arranged on a screen of the liquid crystal display section 620. In the present embodiment, post-processing modes of the finisher 500 include a non-sort (group) mode, a sort mode, and a staple sort (stitching) mode. These processing modes are set by input operations carried out on the operating and display section 600.

Figure 7A:
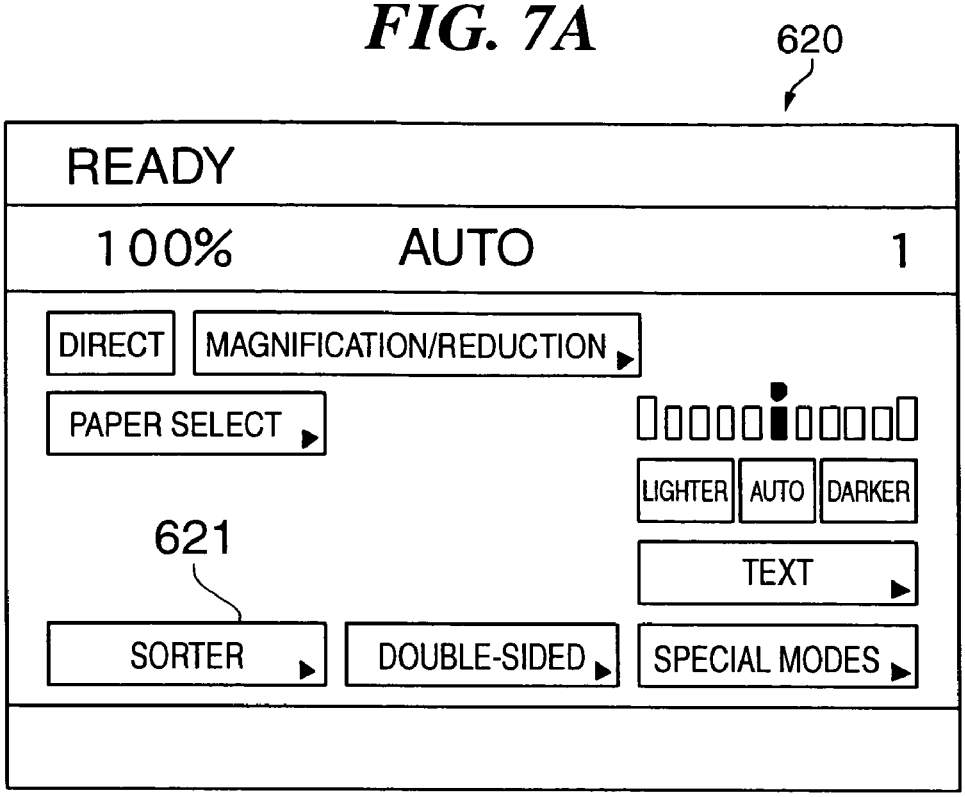
Figure 7B:
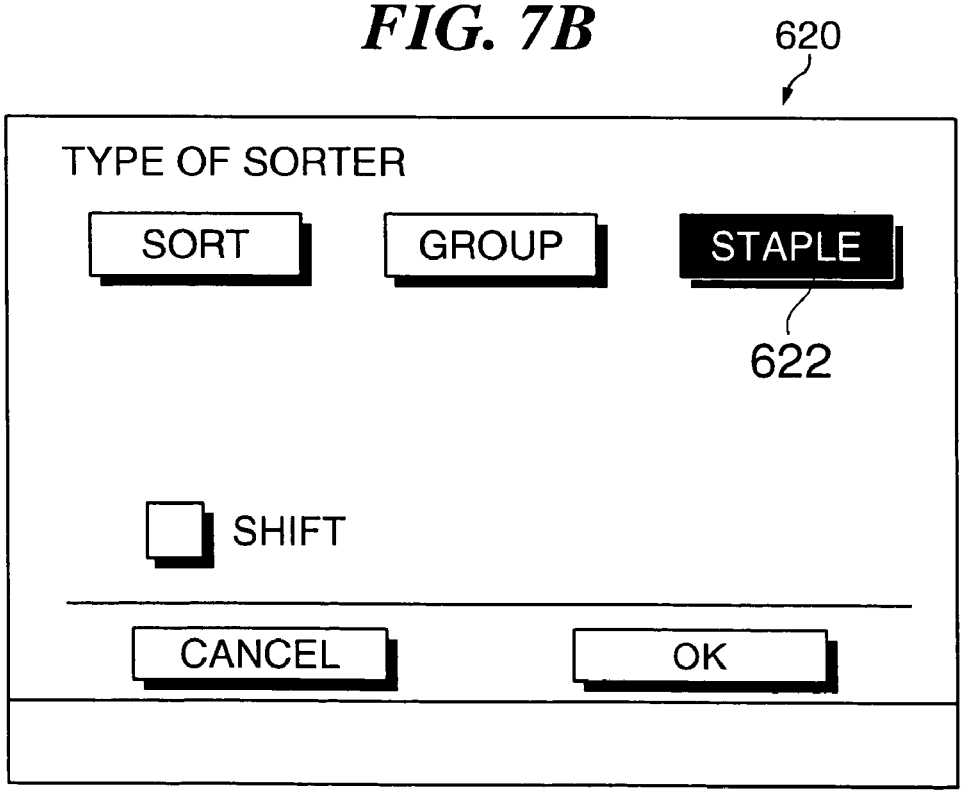

FIGS. 7A and 7B are views showing the soft keys arranged on the liquid crystal display section 620 in FIG. 6. If a "Sorter" key 621, which is a soft key, is selected on an initial screen of the display section 620 in FIG. 7A, a menu option screen appears as shown in FIG. 7B. The processing mode is set on this menu option screen.

FIGS. 8A to 8H are views useful in explaining a buffering operation using the double-sided sheet conveying path 145. It is assumed here that three page originals are stapled. If a "Staple" key 622 appearing in FIG. 7B is pressed first to select the staple sort mode, the printer controller 180 and the finisher controller 580 cooperate to cause the entire image forming apparatus to carry out stapling according to an instruction given by the CPU circuit section 160.

The printer controller 180 determines whether to carry out the buffering operation or not, depending upon the specified mode. For example, if the set mode requires stapling and at the same time image formation is carried out on one side surface of each sheet, with two or more copies of the sheets being produced, the buffering operation is carried out.

First, for a first bundle, processing similar to that in the single-sided mode operation described before is carried out. Namely, a developer image is formed on the photosensitive drum 115 for a sheet for a first page fed from one of the respective cassettes 101*a* to 101*d* or from the manual feed tray 105 via the conveying path 147. Then, the developer image is transferred onto the fed sheet by the transfer section 118. The sheet which has passed through the fixing section 121 is guided to the conveying path 142 by the flapper 133. The sheet then passes through the pair of discharging rollers 111, and is discharged from the printer 100 toward the external finisher 500 (refer to FIG. 8A).

Figure 8B:
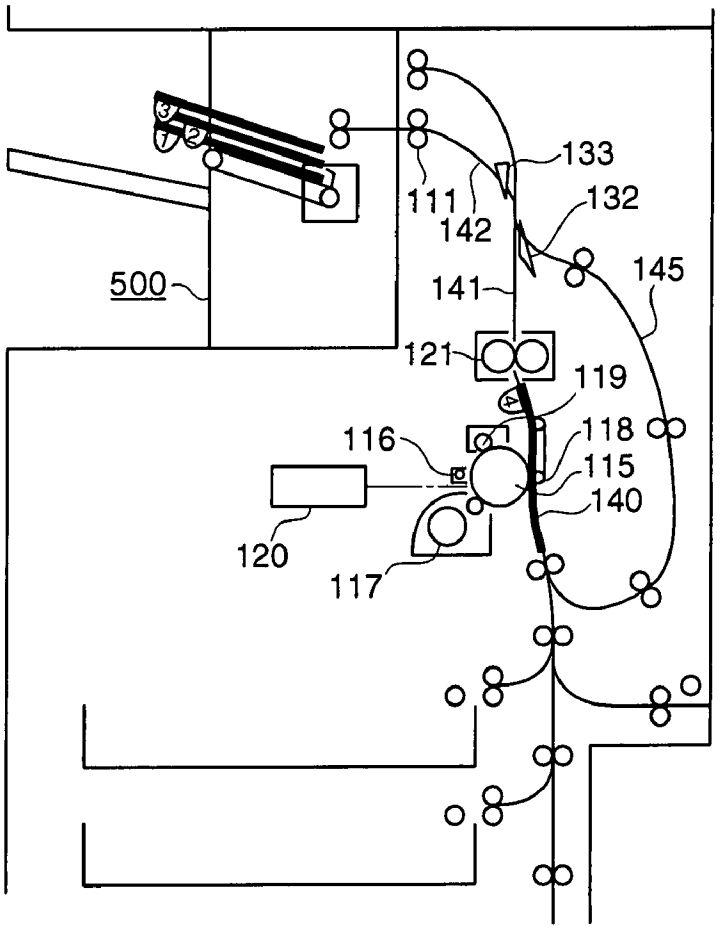
Figure 8A:
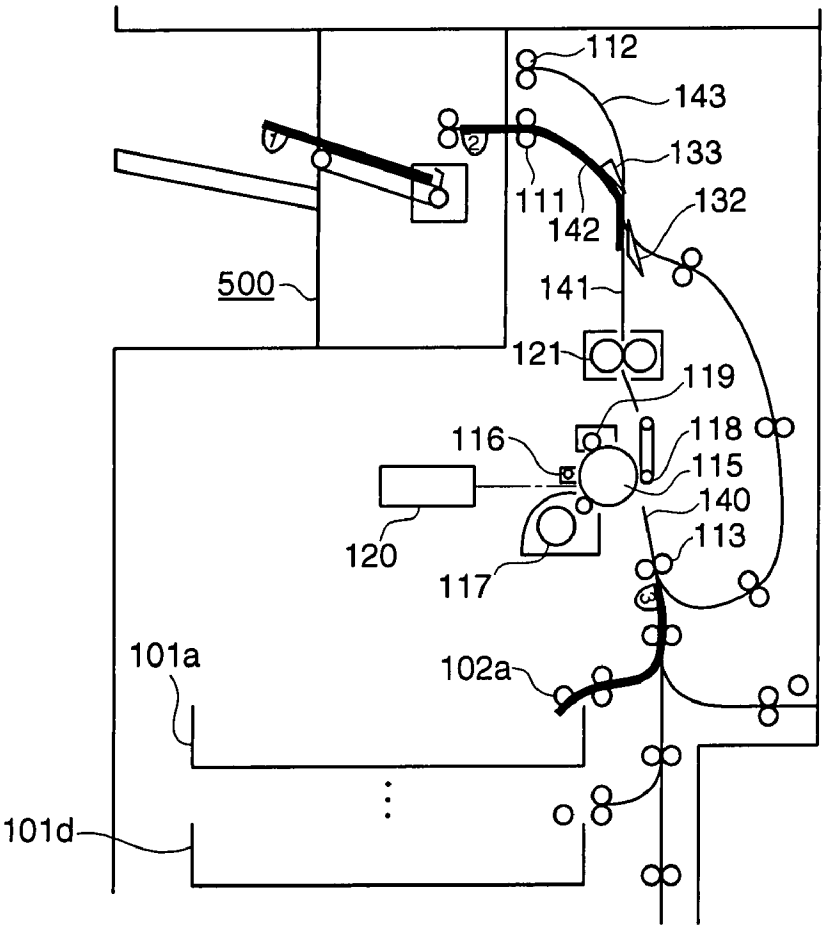
Figure 8D:
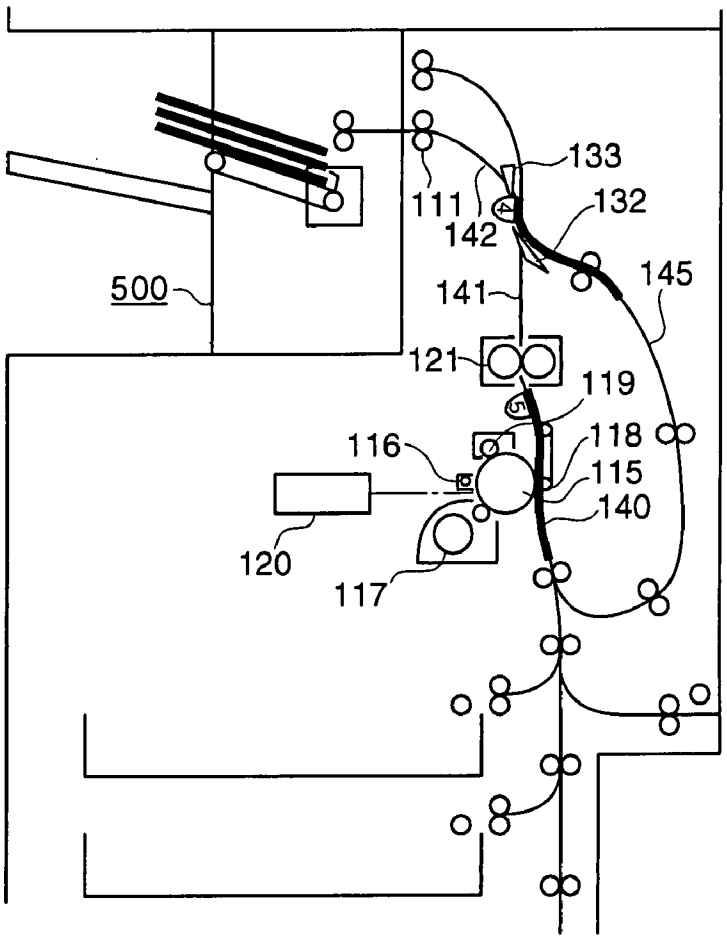
Figure 8C:
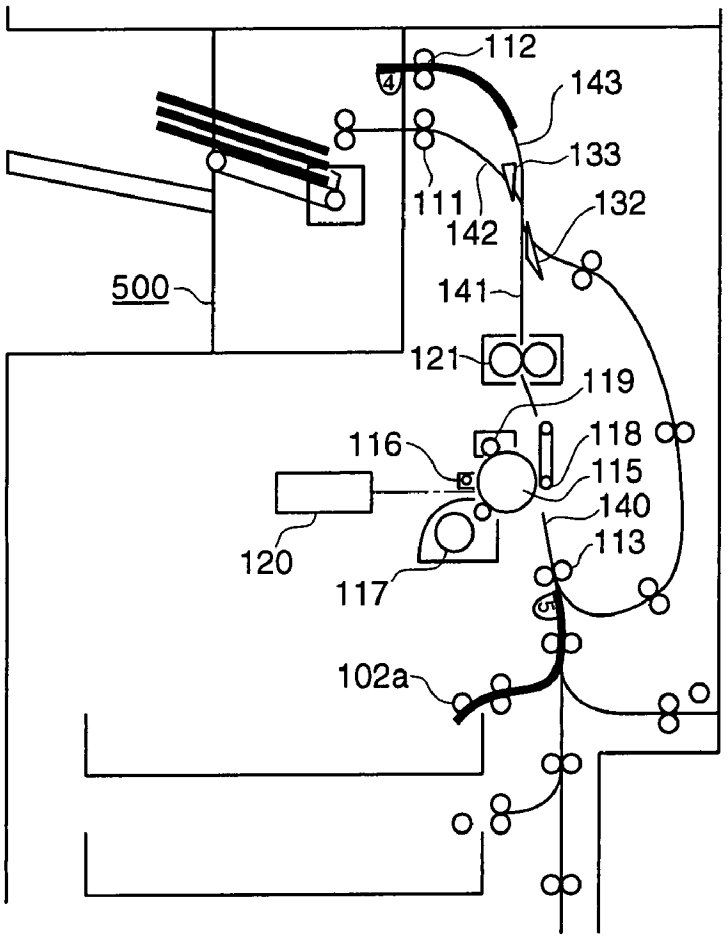

Similarly, images are also formed on sheets for second and third pages, and these sheets are then discharged to the finisher 500 (refer to FIG. 8B). When the three pages of sheets corresponding to one bundle are discharged as a unit to be stapled on the intermediate processing tray, the pair of aligning plates 506 align the sheets, and the stapler 505 staples the sheets. The one bundle of the stapled sheets is discharged onto the stack tray 507 by the bundle discharge belt 503.

While the one bundle of sheets are being aligned and stapled, if the following sheet is discharged to the finisher 500, there is a fear that the first bundle is not stapled correctly or the following sheet is stapled together with the first bundle. Therefore, it is preferable to configure such that the following sheet from the printer 100 is not discharged to the finisher 500 until after the first bundle is stapled and then discharged onto the stack tray 507.

To this end, according to the present embodiment, a fourth sheet to be contained in a second bundle is caused to pass through the fixing section 121, and is guided from the conveying path 141 to the conveying path 143 by switching the flapper 133 (refer to FIG. 8C) as in the above described operation in the double-sided mode. Thereafter, the pair of the inversion rollers 112 is reversely driven and the flapper 132 is switched, so that the sheet is guided from the conveying path 143 to the double-sided sheet conveying path 145 (refer to FIG. 8D). Similarly, a fifth sheet is guided from the fixing section 121 via the conveying path 141 and the conveying path 143 (refer to FIG. 8E) to the double-sided sheet conveying path 145 (refer to FIG. 8F).

By this time, the finisher 500 has stapled the first bundle, and the first bundle is discharged onto the stack tray 507. The fourth and fifth sheets on standby in the double-sided sheet conveying path 145 are conveyed from the double-sided sheet conveying path 145 to the conveying path 142 when a predetermined time period has elapsed after the start of the stapling of the first bundle, and are discharged to the finisher 500 (refer to FIGS. 8G and 8H).

A detailed description will now be given of the movements of the sheets on the double-sided sheet conveying path 145.

Figure 9A:
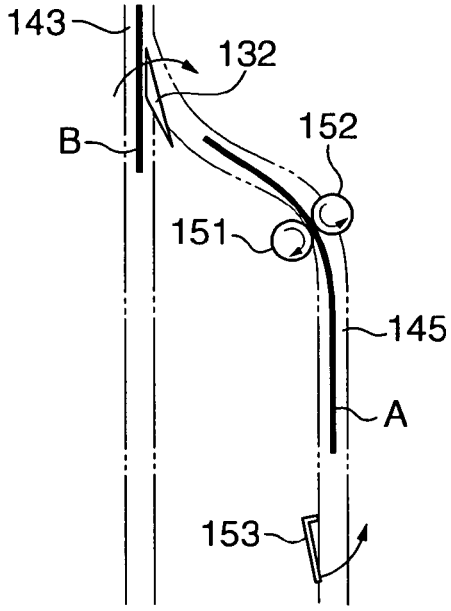

FIGS. 9A to 9E are views useful in explaining movements of sheets on the double-sided sheet conveying path 145. FIG. 9A is a view showing movements of sheets on the double-sided sheet conveying path 145 corresponding in timing to a state intermediate between the states in FIGS. 8D and 8E. After a sheet A (a sheet on which an image for a fourth page is formed) has been conveyed to the double-sided sheet conveying path 145, the flapper 132 switches the sheet conveyance path for the following sheet B (a sheet on which an image for a fifth page is formed) to the conveying path 143. Conveying rollers 151 and 152 rotate in a direction for conveyance of the sheet A to the double-sided sheet conveying path 145. In addition, in the double-sided mode, a movable stopper 153 retracted in a wall of the double-sided sheet conveying path 145 moves to a position to support the leading edge of the sheet A according to the size of the sheet A.

Figure 8F:
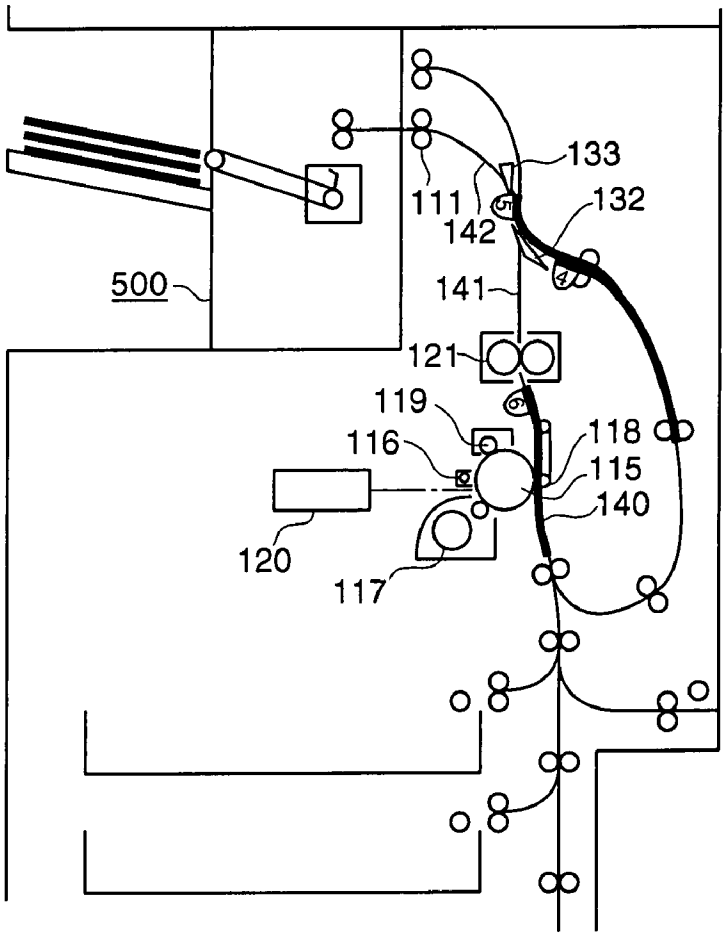
Figure 8E:
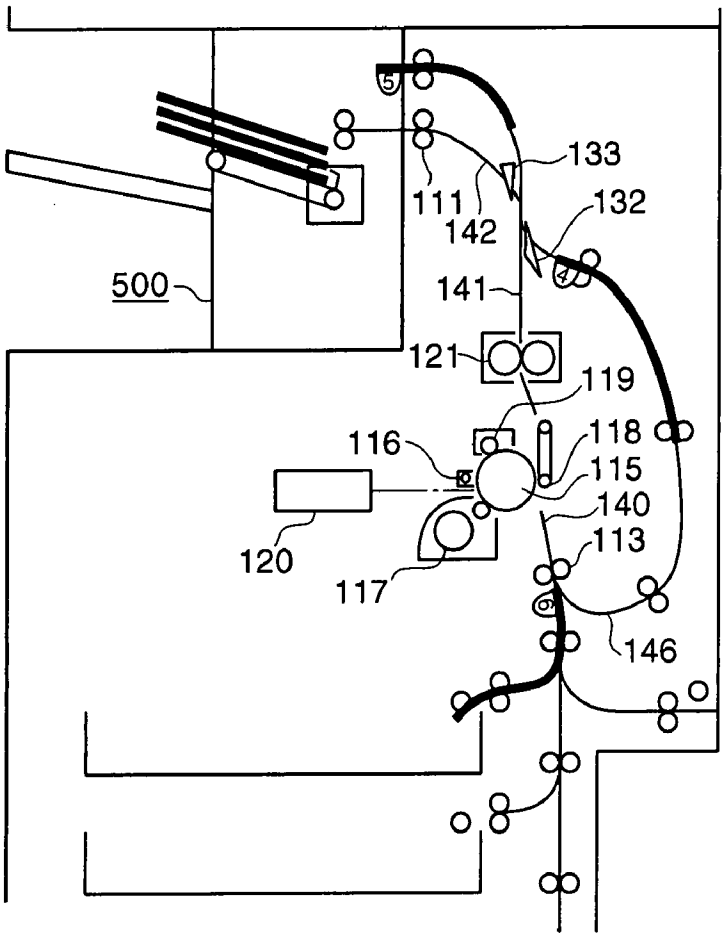
Figure 8H:
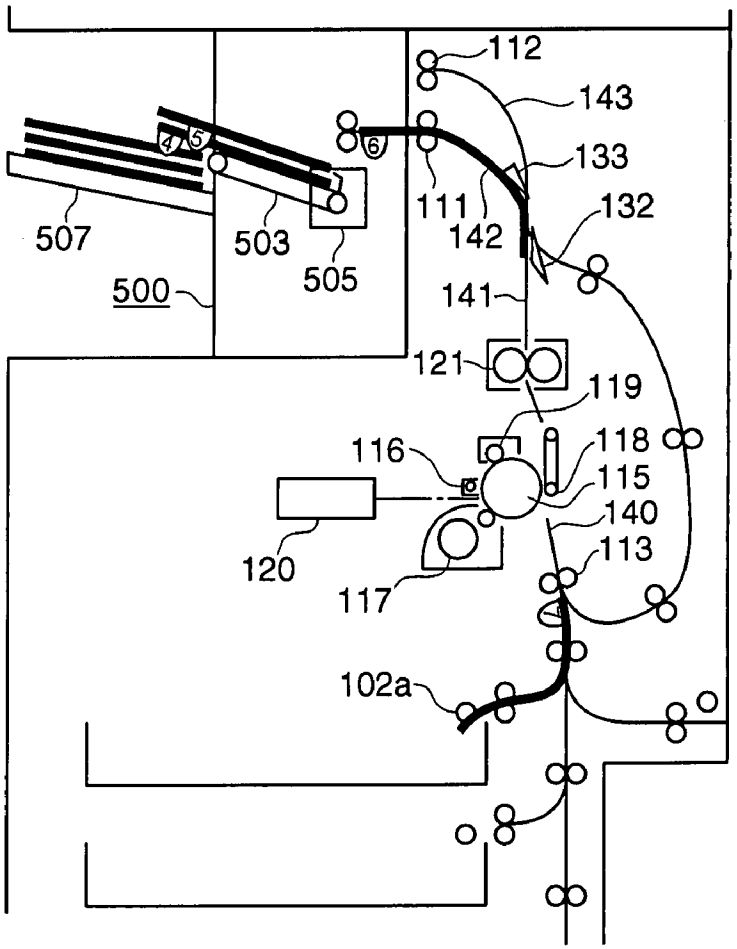
Figure 9B:
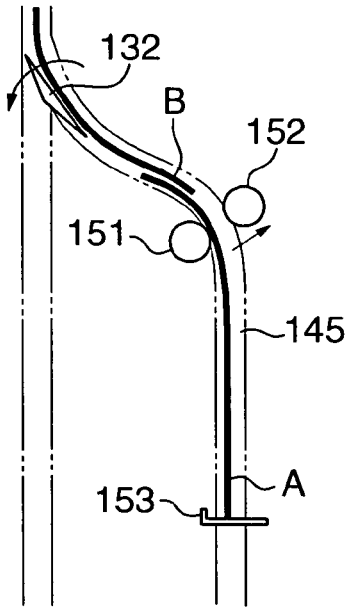
Figure 9C:
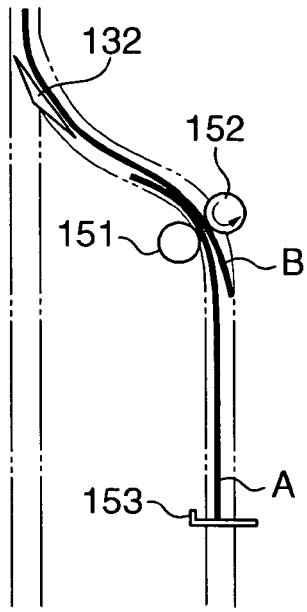

FIGS. 9B and 9C are views showing movements of sheets on the double-sided sheet conveying path 145 corresponding in timing to the state in FIG. 8F. The sheet A is retained in the double-sided sheet conveying path 145. The movable stopper 153 then supports the sheet A to prevent the sheet A from falling downward on the double-sided sheet conveying path 145. The flapper 132 switches the sheet conveying path for the following sheet B to the double-sided sheet conveying path 145. The conveying rollers 151 and 152 stop rotating to suspend the conveyance of the sheet A, and the conveying roller 152 retracts from the conveying roller 151 to provide a gap to pinch the sheet B (refer to FIG. 9B).

When the leading edge of the sheet B passes between the conveying rollers 151 and 152, the conveying roller 152 is brought into contact with the roller 151. Thereafter, only the conveying roller 152 is rotated in a direction to convey the sheet B onto the double-sided sheet conveying path 145 without rotating the conveying roller 151, to thereby convey only the sheet B to the double-sided sheet conveying path 145 without conveying the sheet A (refer to FIG. 9C).

Figure 9D:
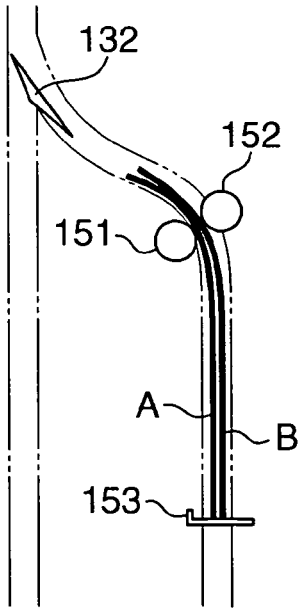

When the sheet B is conveyed until the leading edge thereof comes into contact with the movable stopper 153, the conveying roller 152 stops rotating (refer to FIG. 9D)

Figure 8G:
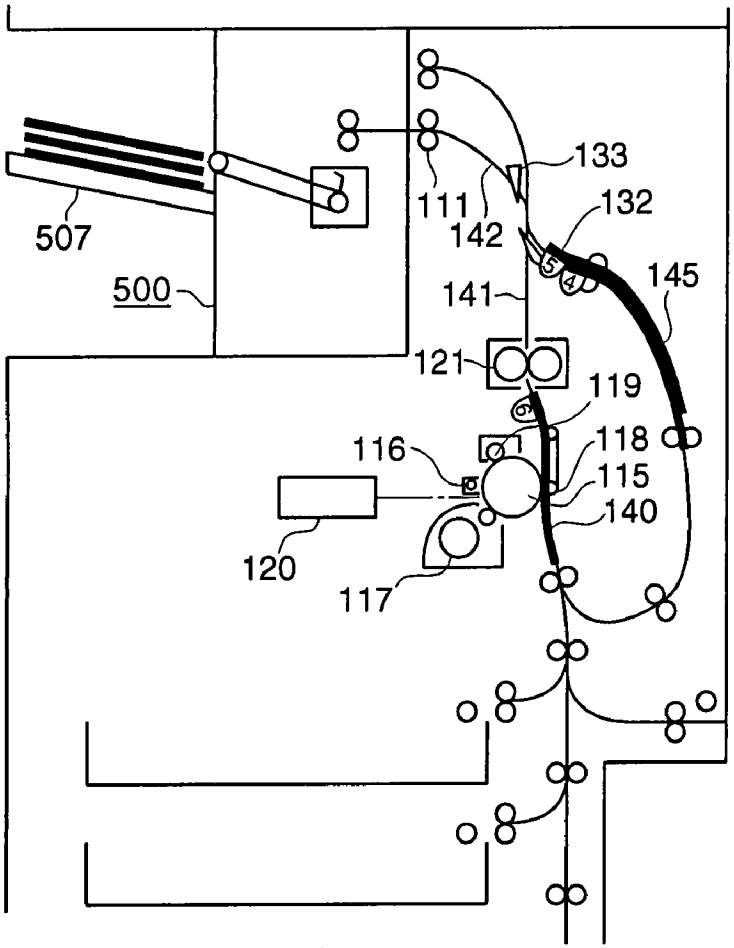
Figure 9E:
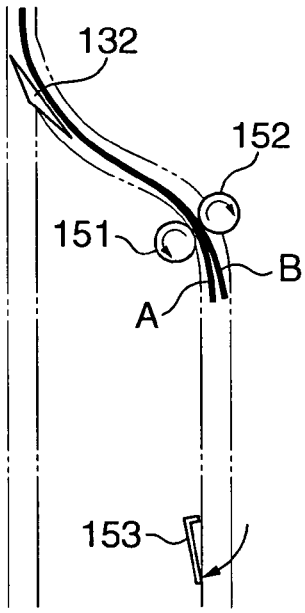

FIG. 9E is a view showing movements of the sheets on the double-sided sheet conveying path 145, which corresponds in timing to the state in FIG. 8G.

Thereafter, when the finisher 500 completes the processing and the sheets on the double-sided sheet conveying path 145 are then discharged, both the conveying rollers 151 and 152 are rotated to convey both the sheets A and B from the double-sided sheet conveying path 145 to the conveying path 142 (refer to FIG. 9E).

It is not necessary to delay discharge of a sixth sheet on which image formation is carried out next, to the finisher 500. Therefore, the sixth sheet which has passed through the fixing section 121 is guided to the conveying path 142 by the flapper 133, and is discharged from the printer 100 via the pair of discharging rollers 111 to the finisher 500 (refer to FIG. 8H). When the sixth sheet is discharged, the three pages of sheets corresponding to one bundle to be stapled have been discharged onto the intermediate processing tray. Therefore, edges of the three pages of sheets are aligned by the pair of aligning plates 506, the stapler 505 staples the sheets, and the bundle discharging belt 503 discharges the bundle of the sheets onto the stack tray 507. Movements of seventh, eighth, and ninth sheets to be contained in a third bundle are similar to those of the fourth, fifth, and sixth sheets in FIGS. 8B to 8H.

Although the present embodiment shows a case where one bundle includes three pages, the number of pages contained in one bundle is not limited to three. If the number of pages contained in one bundle increases, the same operation as that for the sixth sheet described above is simply repeated for the additional sheets. Further, in the present embodiment, when a sheet is shunted on the double-sided sheet conveying path 145, the conveying path 143 is used to reverse the sheet. However, even with a construction which does not include a dedicated path used for reversing a sheet, such as the conveying path 143, and instead a sheet is reversed using the conveying path 142 used for discharge, control similar to that of the present embodiment can be realized.

A description will now be given of measures taken in the event of occurrence of a paper jam while sheets are retained on the double-sided sheet conveying path 145. First, if a sheet is jammed on the conveying path when the sheet is being conveyed to the double-sided sheet conveying path 145, or is being discharged from the double-sided sheet conveying path 145, a sheet or sheets existing at locations closer to a sheet discharge opening than to the double-side sheet conveying path 145 (hereinafter these locations will be referred to as "the downstream locations") are discharged from the sheet discharge opening, and then the operation of the image forming apparatus is stopped.

Then, a cover covering the double-sided sheet conveying path 145 is opened, and the jammed sheet is removed. When the sheet is removed and the cover is closed back to its original state, the image forming apparatus resumes the image forming operation starting with a sheet which was not discharged normally, according to an instruction from the printer controller 180.

On the other hand, if a sheet is jammed at a location closer to the sheet feed cassettes 101*a* to 101*d* than to the double-sided sheet conveying path 145 (hereinafter this location will be referred to as "the upstream location"), a sheet or sheets on the double-sided sheet conveying path 145 are discharged, and then the operation of the image forming apparatus is stopped. For example, if the sixth sheet is jammed in the state in FIG. 8F, the fourth and fifth sheets on the double-sided sheet conveying path 145 are discharged, and the operation of the image forming apparatus is then stopped. After the sixth sheet is removed, the image forming apparatus resumes the image forming operation with the sixth sheet, which was not discharged normally, according to an instruction from the printer controller 180.

Further, if a sheet is jammed in the finisher 500 or on the conveying path 142, which are downstream of the double-sided sheet conveying path 145, the operation of the image forming apparatus is stopped while a sheet or sheets are retained on the double-sided sheet conveying path 145. For example, if the post-processing on the sheets discharged to the finisher 500 in FIGS. 8D and 8E has failed, the operation of the image forming apparatus is stopped after the fifth sheet, on which the image formation is completed, enters the double-sided sheet conveying path 145. Then, after the sheets are removed from the finisher 500, the image forming operation is carried out on the sheets to be contained in the first bundle for which the post-processing has not been completed successfully, according to an instruction from the printer controller 180. The first, second, and third sheets are again discharged to the finisher 500, and post-processing is carried out on these sheets. Then, the fourth and fifth sheets retained on the double-sided sheet conveying path 145 are discharged. Thereafter, the photosensitive drum 115 and the transfer section 118 sequentially form images on the six and subsequent sheets.

When the operation of the image forming apparatus is stopped to remove a paper jam, the cover covering the double-sided sheet conveying path 145, which then need not be opened, may be opened by mistake. Further, a sheet or sheets retained on the double-sided sheet conveying path 145 may be removed, resulting in an improper sequence of sheets when the image forming operation is resumed. To avoid these inconveniences, if the cover covering the double-sided sheet conveying path 145 is opened, an instruction is given for removing the sheet or sheets on the double-sided sheet conveying path 145, and when the image forming operation is resumed, the image formation is sequentially carried out for images including images corresponding to even the sheet or sheets which have been retained.

Figure 10:
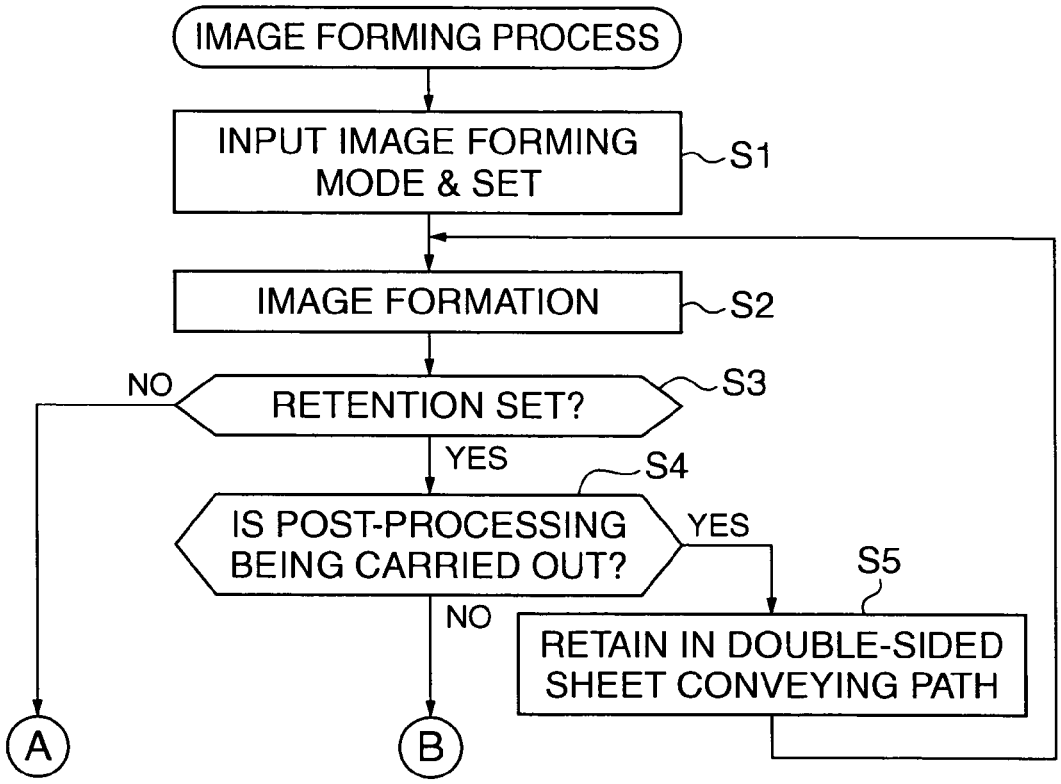
FIG. 10 is a flowchart showing the procedure of an image forming process carried out by the image forming apparatus.
Figure 11:
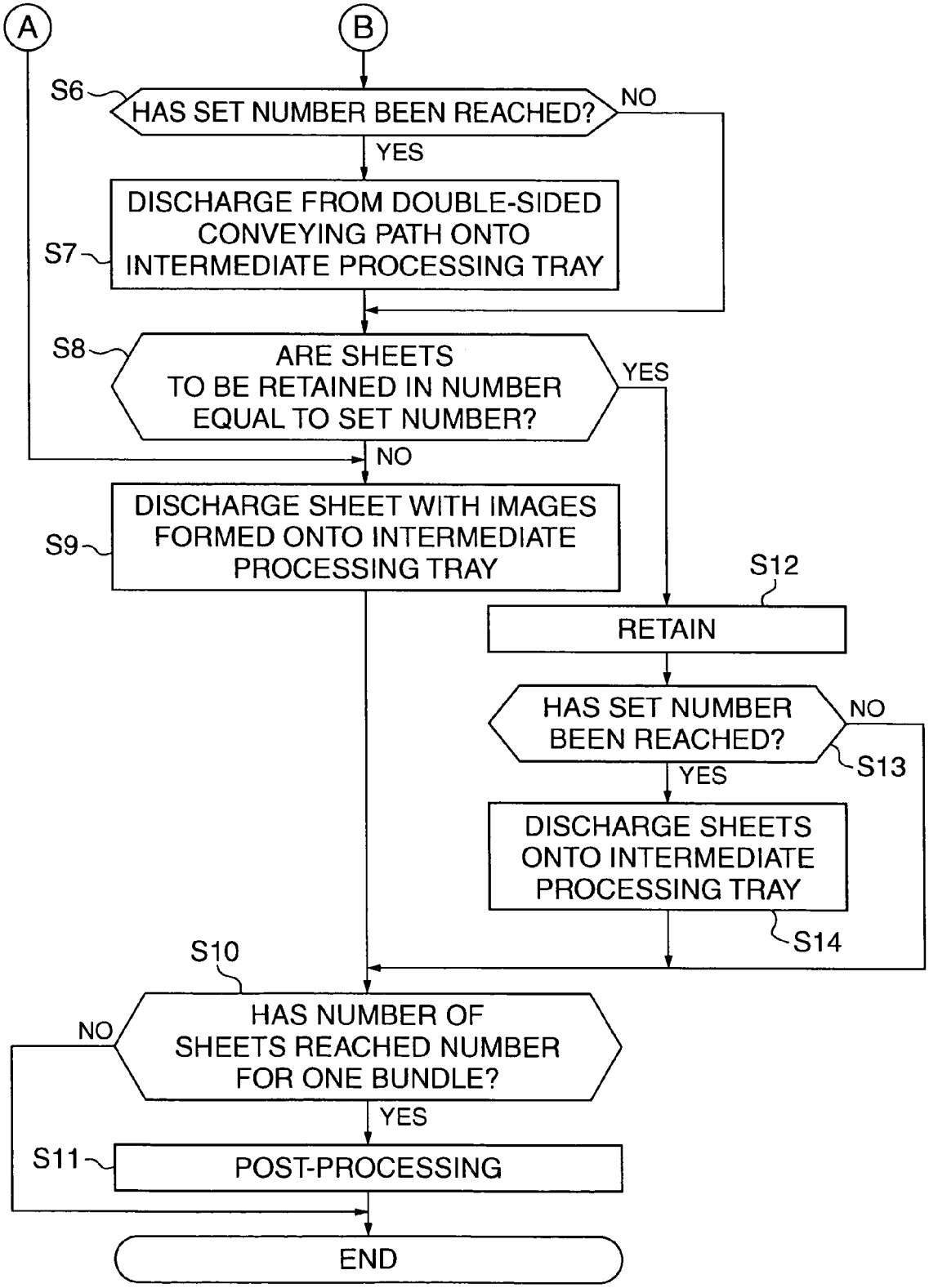
FIG. 11 is a flowchart showing a continued part of the flowchart of FIG. 10.

FIGS. 10 and 11 are flowcharts showing the procedure of an image forming process carried out by the image forming apparatus. A processing program for executing this process is stored in the ROM 162 inside the CPU circuit section 160, and is executed by the CPU 161.

First, an image forming mode designated by an operator is input from the operating and display section 600 (step S1). It is set according to the input image forming mode whether sheets are to be retained on the double-sided sheet conveying path 145 or not, and the number of sheets to be retained is also set if sheets are to be retained. For example, if images are to be formed on sheets corresponding to only one bundle, it is set that no sheet is to be retained. If the input image forming mode is the double-sided mode, it is set that no sheet is to be retained, because the double-sided sheet conveying path 145 is used for conveying sheets and hence cannot be used for buffering sheets.

Then, the image formation is carried out on a sheet which has been conveyed (step S2). Then, it is determined whether it is set that sheets on which the image formation is completed are to be retained (step S3). If it is set that sheets on which the image formation is completed are to be retained, it is determined whether post-processing is being carried out on the intermediate processing tray or not (step S4). If post-processing is being carried out, the sheet on which the image formation is completed is retained on the double-sided sheet conveying path 145 (step S5). Then, the process returns to the step S2, and the image formation is carried out on a sheet which has been conveyed next. On the other hand, if it is determined in the step S3 that no sheet is to be retained, the process proceeds to a step S9, described later.

If it is determined in the step S4 that no post-processing is being carried out on the intermediate processing tray, it is determined whether the number of sheets retained on the double-sided sheet conveying path 145 has reached the set number of the sheets to be retained (step S6). If the number of sheets retained on the double-sided sheet conveying path 145 has reached the set number, the retained sheets corresponding in number to the set number are discharged from the double-sided sheet conveying path 145 onto the intermediate processing tray (step S7). On the other hand, the number of sheets retained on the double-sided sheet conveying path 145 has not reached the set number, the process jumps to a step S8.

It is then determined whether sheets on which the image formation is completed are to be retained in a number equal to the set number (step S8). If the answer is negative, the sheet on which the image formation is completed (that is, the sheet for the sixth page in the present embodiment, for example) is discharged onto the intermediate processing tray without retaining the sheet on the double-sided sheet conveying path 145 (step S9) Then, it is determined whether the number of sheets on the intermediate processing tray has reached the number of sheets to be contained in one bundle (step S10). If the answer is negative, the process is immediately terminated. On the other hand, if the answer is affirmative, the post-processing is carried out on the bundle of sheets (step S11), and the process is terminated.

On the other hand, if it is determined in the step S8 that sheets on which the image formation is completed are to be retained in a number equal to the set number, a sheet (that is, a sheet for a seventh page in a second embodiment, described later, for example) is retained (step S12), and it is determined whether the number of sheets retained has reached the set number (step S13). If the number of sheets retained has reached the set number, the retained sheets corresponding in number to the set number are discharged onto the intermediate processing tray (step S14). On the other hand, if the number of retained sheets has not reached the set number in the step S13, the process jumps to the step S10. It is determined whether the number of sheets on the intermediate processing tray has reached the number of sheets to be contained in one bundle in the step S10. If the number of sheets has reached the number corresponding to one bundle, post-processing is carried out in the step S11, and the process is terminated. On the other hand, if the number of sheets has not reached the number corresponding to one bundle in the step S10, the process is immediately terminated.

In the above embodiment, even if it is determined in the step S3 that sheets are to be retained, when sheets for the first to third pages, for example, are retained, the sheets are discharged onto the intermediate processing tray since post-processing is not being carried out. However, all the sheets for the first to the last pages may be retained irrespective of whether post-processing is being carried out on the intermediate processing tray or not. This can simplify the control program.

Figure 12A:
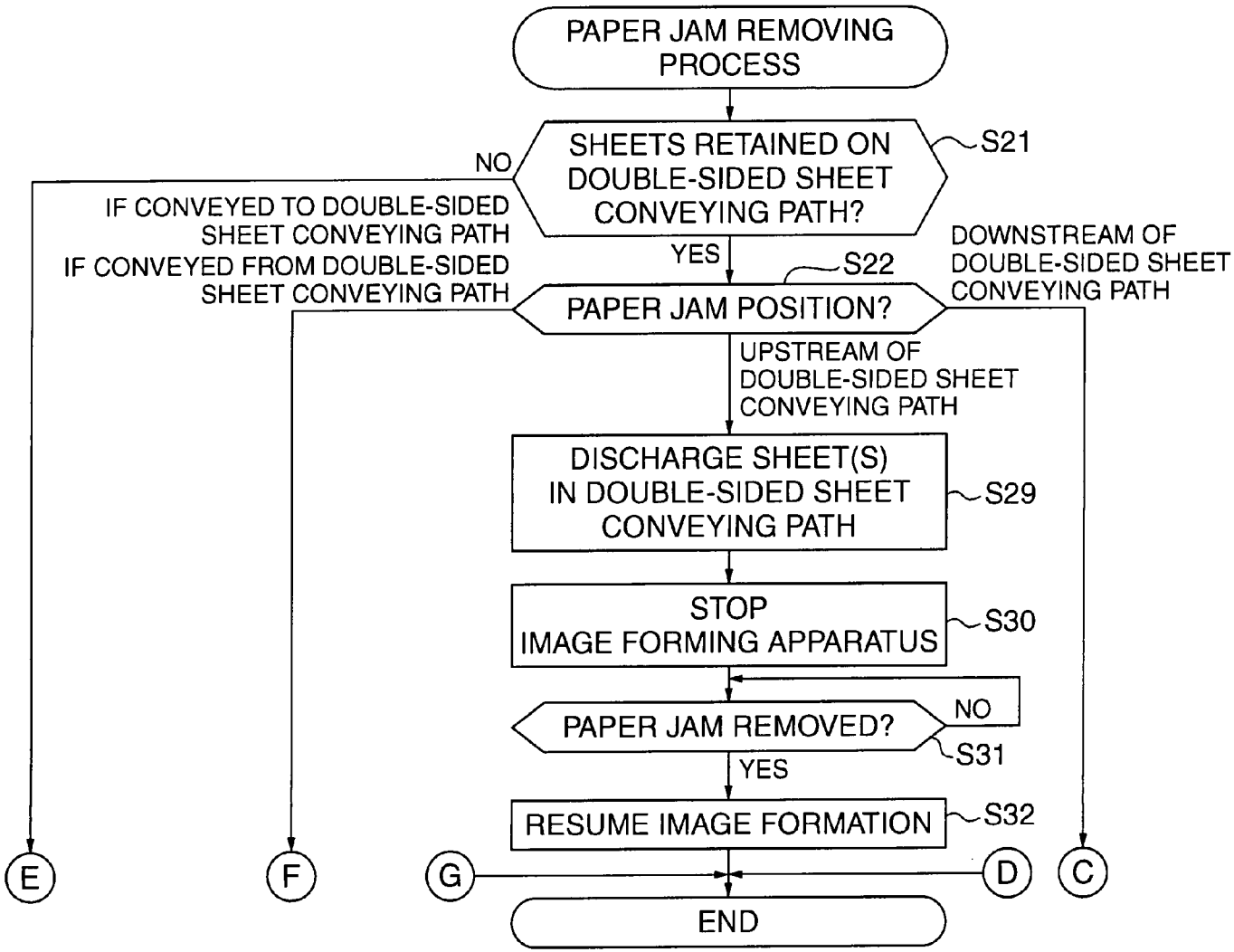
FIGS. 12A and 12B are flowchart showing the procedure of a paper jam removing process carried out by the image forming apparatus.
Figure 12B:
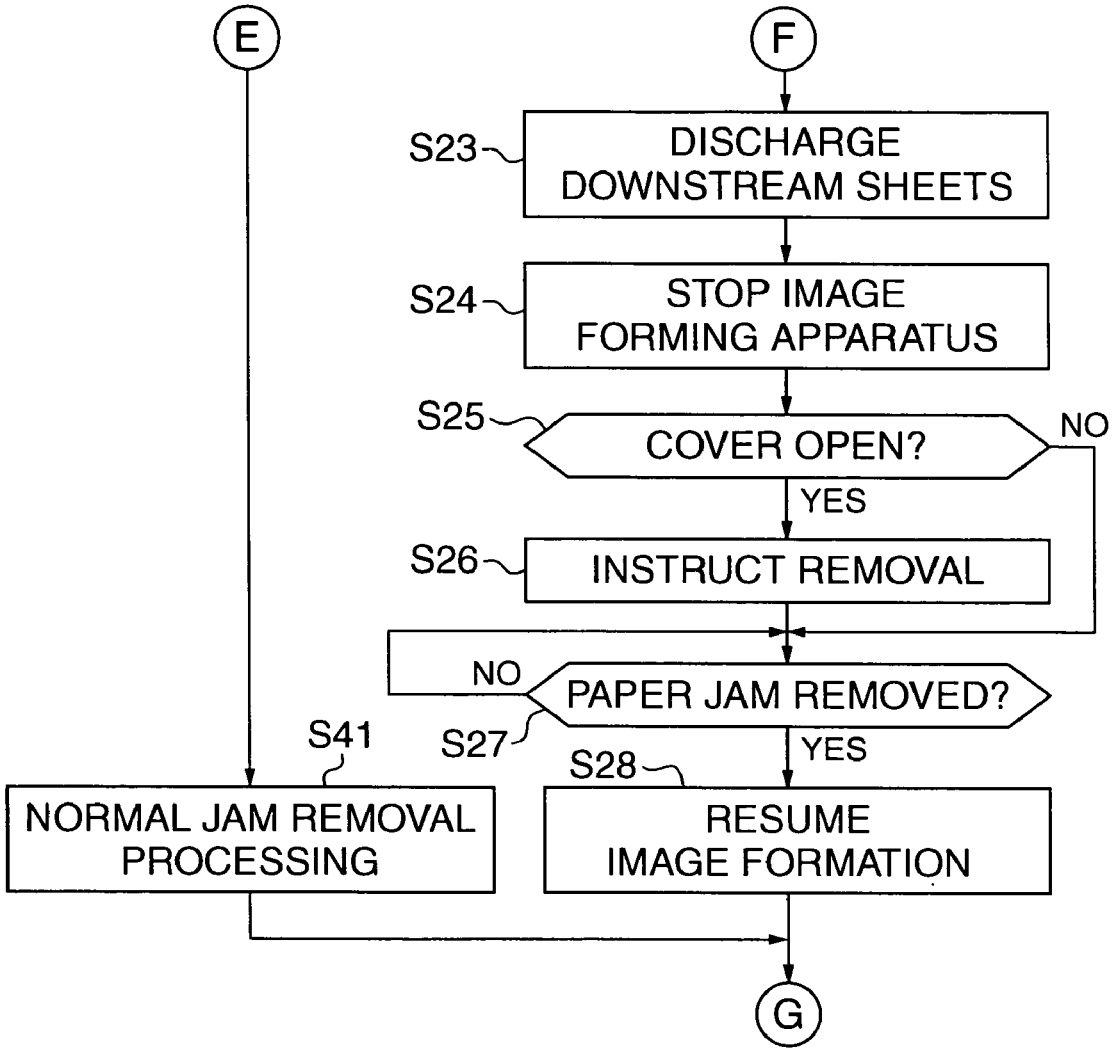
Figure 13:
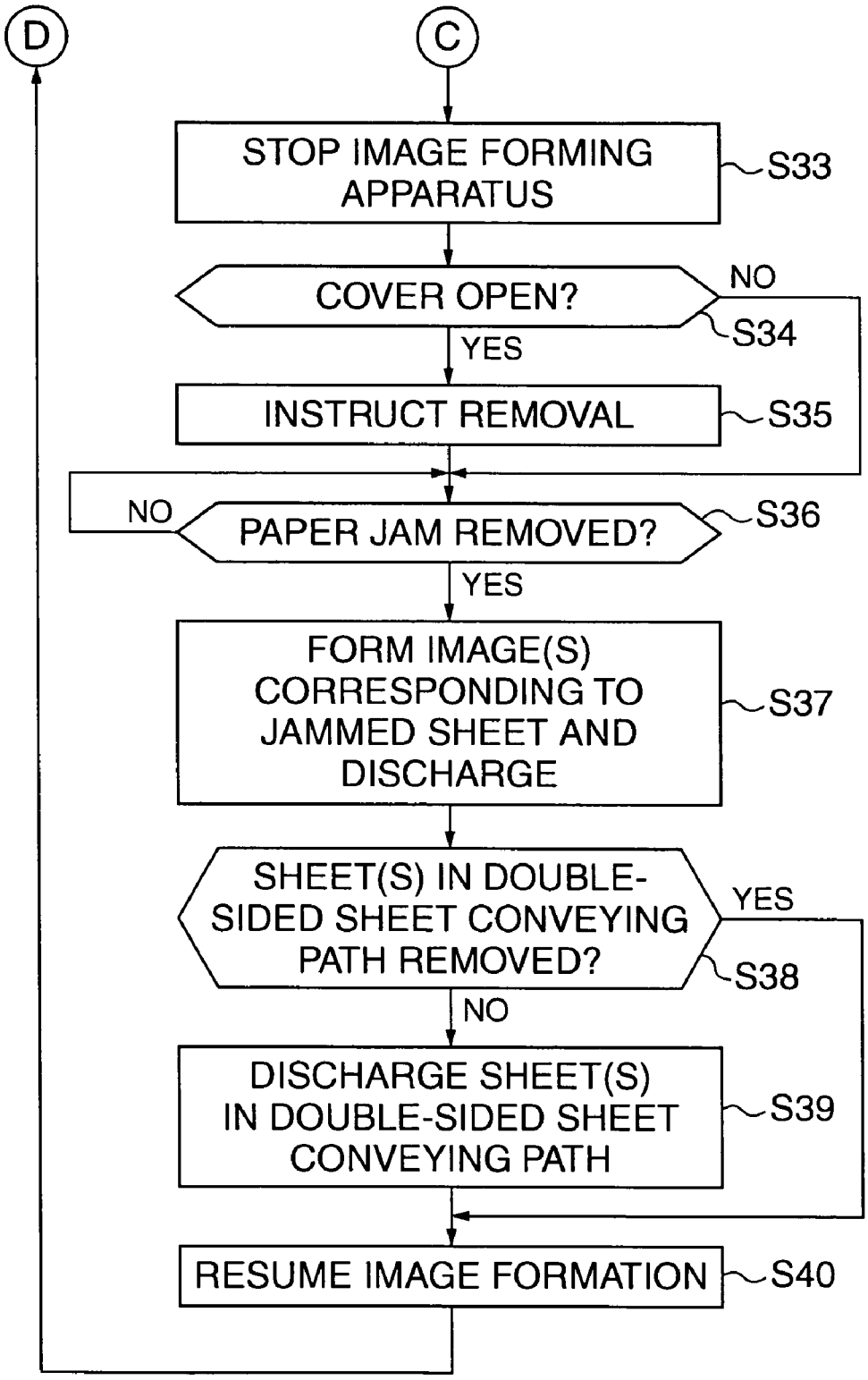
FIG. 13 is a flowchart showing a continued part of the flowchart of FIGS. 12A and 12B.

FIGS. 12A, 12B and 13 are flowcharts showing the procedure of a paper jam removing process carried out by the image forming apparatus. A processing program executing this process is stored in the ROM 162 inside the CPU circuit section 160, and is executed by the CPU 161 each time an interrupt occurs due to a paper jam.

First, it is determined whether one or more sheets are retained on the double-sided sheet conveying path 145 (step S21). If there is no sheet retained, a normal jam removal process is carried out (step S41), and the present process is terminated. On the other hand, if one or more sheets are retained on the double-sided sheet conveying path 145, the position of the paper jam is determined using a sensor, not shown (step S22).

If it is determined in the step S22 that a paper jam has occurred when a sheet is being conveyed to the double-sided sheet conveying path 145, or a sheet is being discharged from the double-sided sheet conveying path 145, a sheet or sheets closer to the discharge opening than to the double-sided sheet conveying path 145 (downstream of the double-sided sheet conveying path 145) are discharged (step S23), and the image forming apparatus is stopped (step S24). On this occasion, a sheet or sheets retained on the double-sided sheet conveying path 145 are kept as they are.

Then, it is determined whether a cover which may come into contact with a sheet or sheets retained on the double-sided sheet conveying path 145 is opened or not (step S25). If no cover is open, the process waits until the sheet causing the paper jam is removed (step S27). On the other hand, if it is determined in the step S25 that such a cover is open, an instruction requesting for removing a sheet or sheets retained on the double-sided sheet conveying path 145 is displayed on the display section 620 of the operating and display section 600 (step S26). In this case, in the step S27, the process waits for the sheet or sheets retained on the double-sided sheet conveying path 145 as well as the sheet causing the paper jam to be removed.

When the sheet causing the paper jam is removed, or the sheet or sheets retained on the double-sided sheet conveying path 145 as well as the sheet causing the paper jam in the step S27 are removed, the image formation is resumed (step S28). On this occasion, if the sheet or sheets retained on the double-sided sheet conveying path 145 are removed in the step S27, the image formation is carried out starting with the sheet or sheets which have been retained on the double-sided sheet conveying path 145. Then, the present process is terminated.

On the other hand, if it is determined in the step S22 that a paper jam occurred at a position closer to the sheet feed cassettes 101*a* to 101*d* than to the double-sided sheet conveying path 145 (upstream of the double-sided sheet conveying path 145), the sheet or sheets retained on the double-sided sheet conveying path 145 are discharged (step S29), and the image forming apparatus is then stopped (step S30). Then, the process waits until the sheet causing the paper jam is removed (step S31) If the sheet causing the paper jam is removed, the image formation is resumed (step S32) Then, the present process is terminated.

On the other hand, if it is determined in the step S22 that a paper jam has occurred in the finisher 500 downstream of the double-sided sheet conveying path 145, or on the conveying path 142, the image forming apparatus is stopped while a sheet or sheets are retained on the double-sided sheet conveying path 145 (step S33).

Then, it is determined whether a cover which may come into contact with a sheet or sheets retained on the double-sided sheet conveying path 145 is opened or not (step S34). If no cover is open, the process waits until the sheet causing the paper jam is removed (step S36). On the other hand, if it is determined in the step S25 that such a cover is open, an instruction requesting for removing the sheets retained on the double-sided sheet conveying path 145 is displayed on the display section 620 of the operating and display section 600 (step S35). In this case, the process waits for a sheet or sheets on the double-sided sheet conveying path 145 as well as the sheet causing the paper jam to be removed in the step S36.

When the sheet causing the paper jam is removed, or the sheet or sheets retained on the double-sided sheet conveying path 145 as well as the sheet causing the paper jam in the step S36 are removed, the image formation is carried out for an image corresponding to the sheet causing the paper jam, and a sheet on which the image formation is completed is then discharged (step S37). Then, it is determined whether the sheet or sheets on the double-sided sheet conveying path 145 have been removed or not (step S38). If the sheet or sheets have not been removed, the sheet or sheets on the double-sided sheet conveying path 145 are discharged (step S39), and the image formation is resumed (step S40). Then, the present process is terminated. On the other hand, if the sheet or sheets on the double-sided sheet conveying path 145 have been removed in the step S38, the image formation is resumed for images including one or more images corresponding to the sheets retained on the double-sided sheet conveying path 145 in the step S40. Then, the present process is terminated.

FIGS. 14A to 14H are views showing a buffering operation using the double-sided sheet conveying path 145 according to the second embodiment. In the present embodiment, it is assumed here that four page originals are stapled. In the present embodiment, the manner of selection of a staple sort mode and the determination as to whether to carry out the buffering operation or not are identical to those of the above described first embodiment.

Moreover, the processing of a first bundle is identical to that in the first embodiment. As for the processing of a second bundle, processing up to storing fifth and sixth sheets, which are first two sheets in the second bundle, in the double-sided sheet conveying path 145 is identical to that in the above described first embodiment (refer to FIGS. 14A to 14F). On this occasion, that is, when fifth and sixth sheets are stored, the finisher 500 has stapled the first bundle, and the first bundle has been discharged onto the stack tray 507.

Then, a seventh sheet on which the image formation is completed is conveyed from the fixing section 121 to the conveying path 141 and further conveyed to the conveying path 143 by the switching of the flapper 133. Then, the seventh sheet is set on standby at the inversion section. When the seventh sheet passes the flapper 133, the flapper 133 is switched again. The fifth and sixth sheets waiting on the double-sided sheet conveying path 145 are then both conveyed from the double-sided sheet conveying path 145 to the conveying path 142, and are discharged to the finisher 500 (refer to FIG. 14G).

Figure 14B:
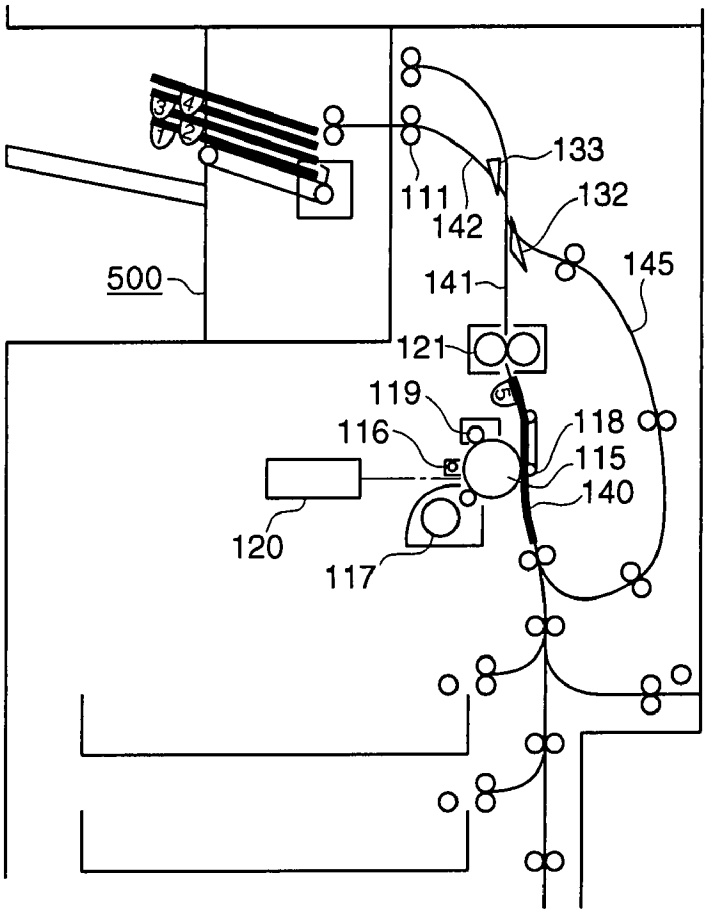
Figure 14A:
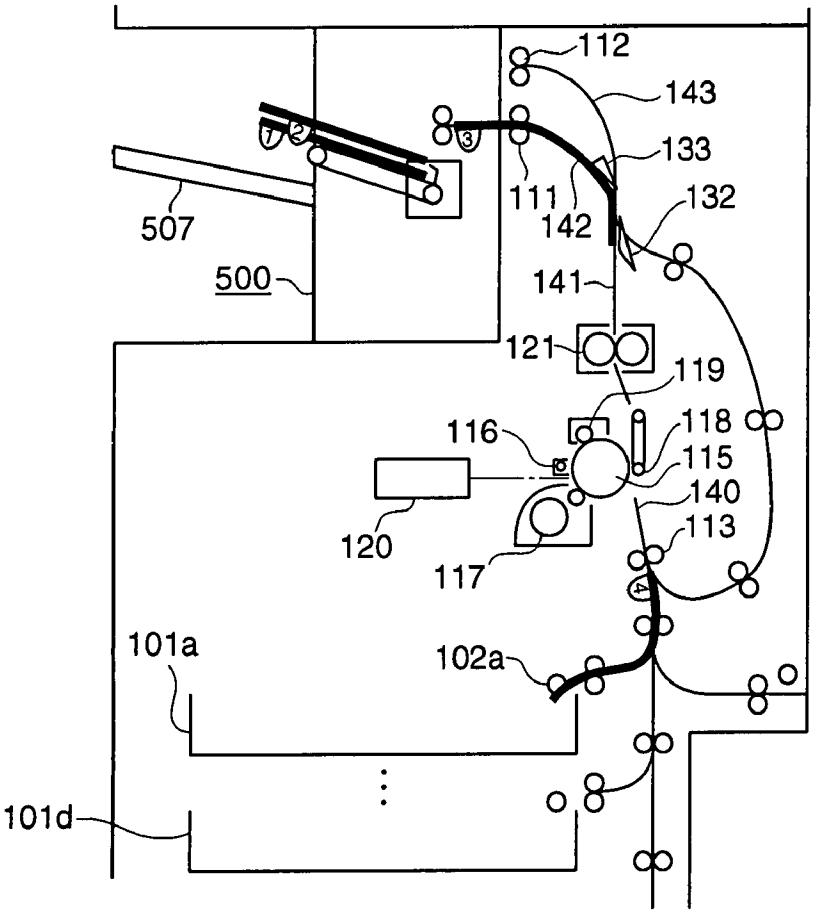
Figure 14D:
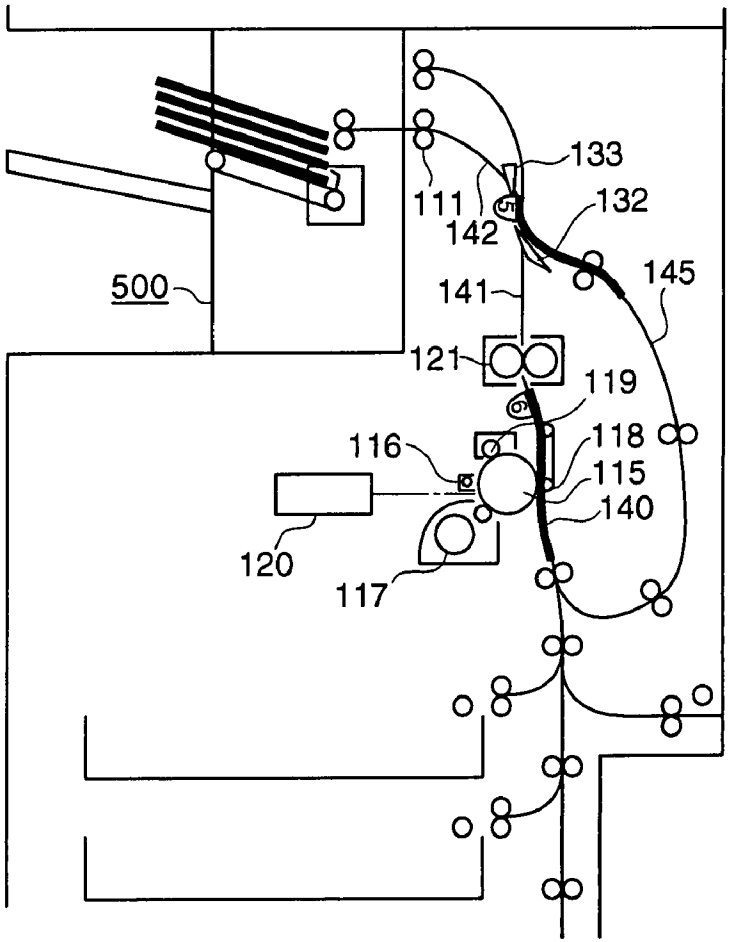
Figure 14C:
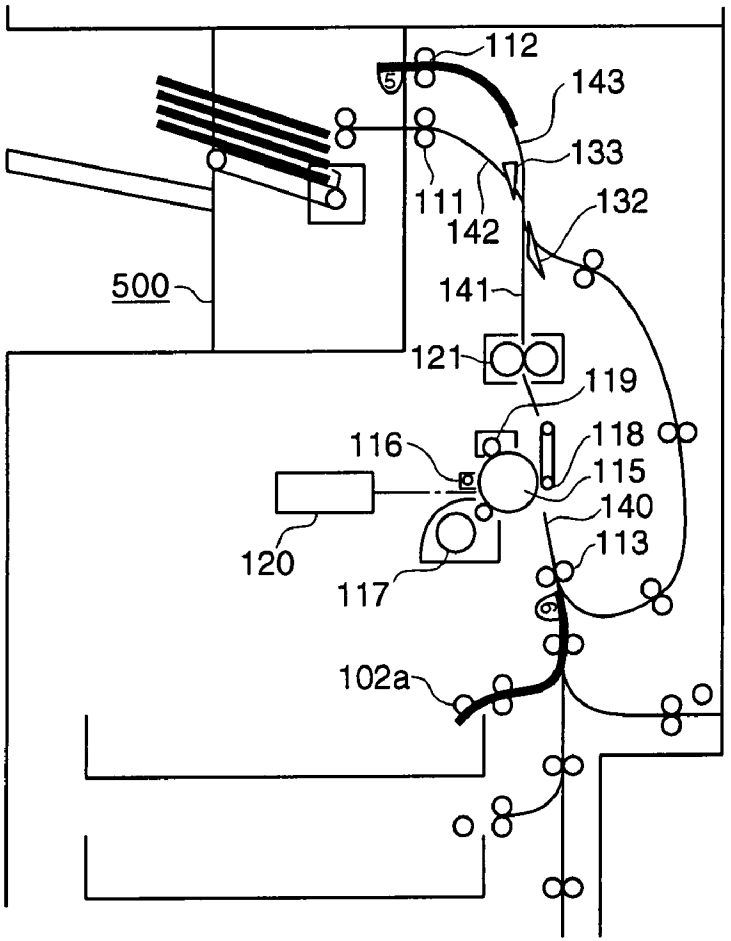
Figure 14F:
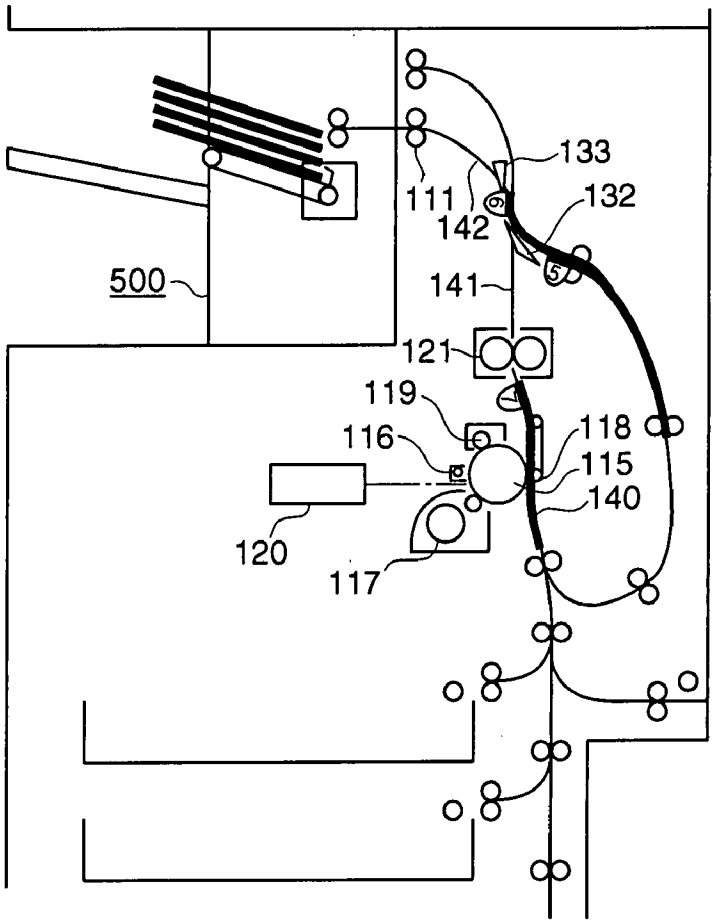
Figure 14E:
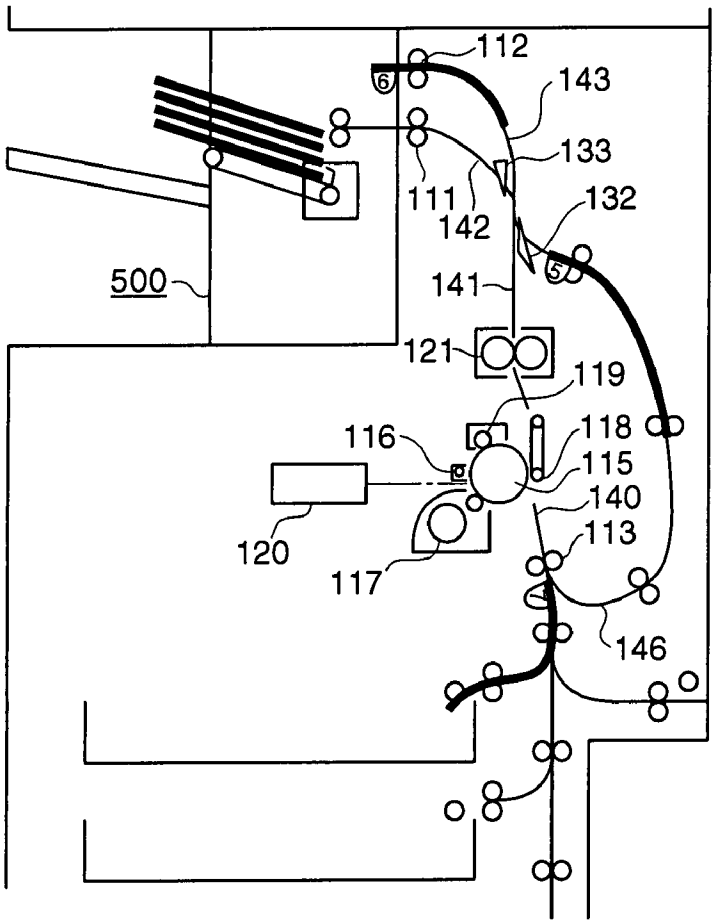
Figure 14H:
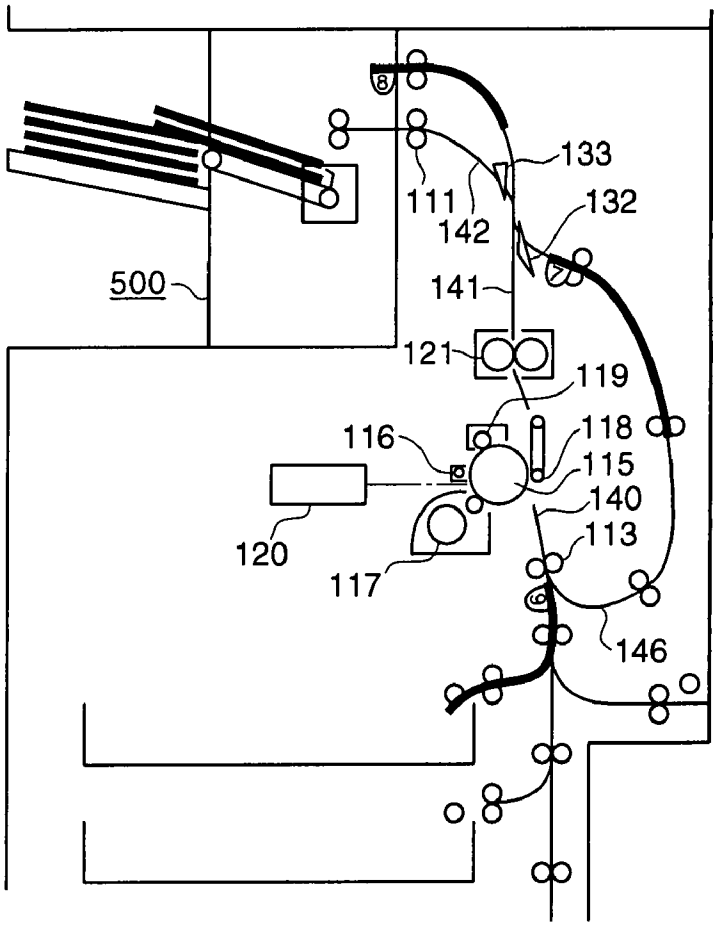
Figure 14G:
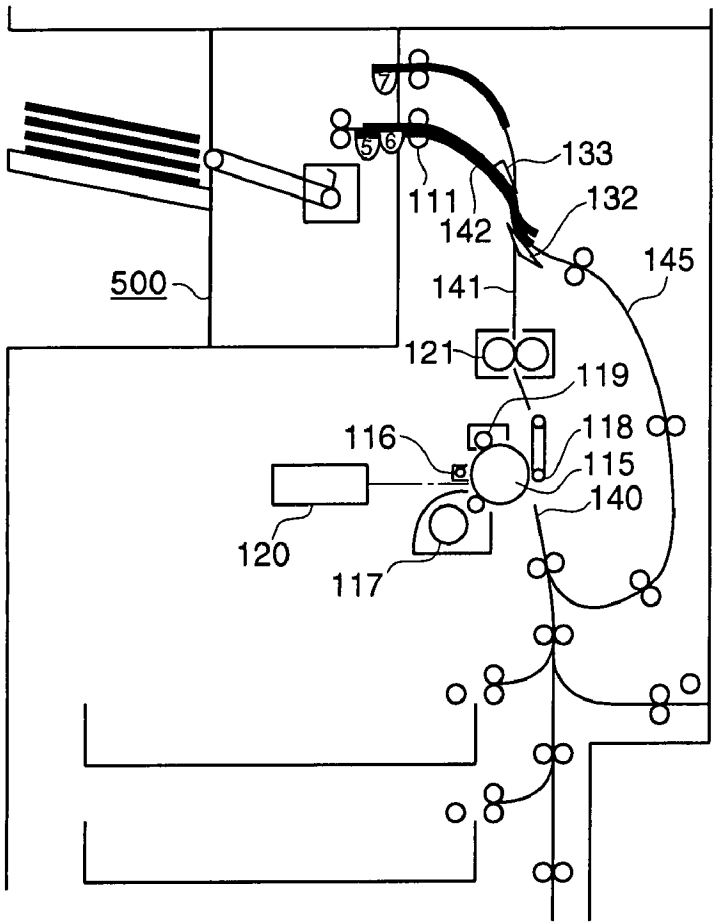

After the fifth and sixth sheets passes the flapper 133, the flapper 133 is switched again, and the seventh sheet is guided from the conveying path 143 to the double-sided sheet conveying path 145 (refer to FIG. 14H). On the other hand, the following or eighth sheet is also guided from the fixing section 121 to the double-sided sheet conveying path 145 via the conveying paths 141 and 143. Thereafter, in a similar manner, the image formation is carried out up to the last sheet while two sheets are shunted on the double-sided sheet conveying path 145 each time, as shown in FIGS. 14E to 14H.

Although in the present embodiment, control is carried out without shunting the first bundle to the double-sided sheet conveying path 145, control may, of course, be carried out to shunt also the first bundle to the double-sided sheet conveying path 145. In this case, it is not necessary to change the processing only for the first bundle, and the conveyance control can thus be simplified. Although in the present embodiment, the number of pages in one bundle is an even number, if the number of pages is an odd number, the number of sheets shunted to the double-sided sheet conveying path 145 may be reduced or increased by one page at the start of processing of one bundle or at the end of processing of one bundle, thus providing control substantially identical to the control for one bundle including an even number of pages.

Although in the present embodiment, two sheets are shunted on the double-sided sheet conveying path 145 to wait for stapling, if the stapling requires a long period of time, a similar operation may be carried out by increasing the number of sheets to be shunted to three or more. Conversely, if the stapling requires a long period of time, one sheet may be shunted, providing substantially the same results. Processing carried out by the finisher is not limited to the stapling process as carried out in the present embodiment, but may include punching, folding, and book binding.

It should be understood that the present invention is not limited to the above described first and second embodiments, but various variations of the above described embodiments may be possible without departing from the spirit of the present invention.

According to the above described embodiments, the buffering function can be realized, which enables post-processing without decreasing the productivity and increasing the size.

CROSS REFERENCE TO RELATED APPLICATION

This application claims priority from Japanese Patent Application No 2003-336032 filed Sep. 26, 2003, which is hereby incorporated by reference herein.

What is claimed is:

1. An image forming apparatus comprising:

an image forming unit that forms at least one image on a sheet;

a double-sided sheet conveying path which the sheet passes when being conveyed back to said image forming unit again to form an image on an opposite side surface of the sheet after an image is formed on one side surface of the sheet;

a retaining member that is provided on said double-sided sheet conveying path to retain the sheet on said double-sided sheet conveying path;

a post-processing device that carries out post-processing on sheets on which images have been formed by said image forming unit;

a controller that controls conveyance of the sheet;

a conveying destination designating device that designates said double-sided sheet conveying path as a conveying destination of the sheet on which at least one image has been formed by said image forming unit when said post-processing device is carrying out post-processing, and designates said post-processing device as the conveying destination of the sheet on which at least one image has been formed by said image forming unit, when said post-processing device is not carrying out post-processing;

an image forming mode input device that inputs an image forming mode; and a retention determining device that determines whether said retaining member is to retain the sheet on which at least one image has been formed by said image forming unit, based on the input image forming mode, wherein said controller provides control to convey the sheet on which the at least one image has been formed by said image forming unit to said double-sided sheet conveying path, cause said retaining member to temporarily retain the sheet on said double-sided sheet conveying path, and then convey the sheet to said post-processing device, wherein said controller provides control to convey the sheet on which at least one image has been formed by said image forming unit to the conveying destination designated by said conveying destination designating device, and wherein said retention determining device determines that said retaining member is not to retain the sheet when the input image forming mode is a mode in which images are formed on opposite side surfaces of the sheet.

2. An image forming apparatus comprising:

an image forming unit that forms at least one image on a sheet;

a double-sided sheet conveying path which the sheet passes when being conveyed back to said image forming unit again to form an image on an opposite side surface of the sheet after an image is formed on one side surface of the sheet;

a retaining member that is provided on said double-sided sheet conveying path to retain the sheet on said double-sided sheet conveying path;

a post-processing device that carries out post-processing on sheets on which images have been formed by said image forming unit;

a controller that controls conveyance of the sheet; and a conveying destination designating device that designates said double-sided sheet conveying path as a conveying destination of the sheet on which at least one image has been formed by said image forming unit when said post-processing device is carrying out post-processing, and designates said post-processing device as the conveying destination of the sheet on which at least one image has been formed by said image forming unit, when said post-processing device is not carrying out post-processing, wherein said controller provides control to convey the sheet on which the at least one image has been formed by said image forming unit to said double-sided sheet conveying path, cause said retaining member to temporarily retain the sheet on said double-sided sheet conveying path, and then convey the sheet to said post-processing device, wherein said controller provides control to convey the sheet on which at least one image has been formed by said image forming unit to the conveying destination designated by said conveying destination designating device, and wherein said controller is operable when a paper jam occurs in the image forming apparatus while the sheet is retained on said double-sided sheet conveying path by said retaining member, to provide control to stop operation of the image forming apparatus while allowing the sheet to be retained on said double-sided sheet conveying path, and discharge the sheet retained on said double-sided sheet conveying path when said controller restarts the operation of the image forming apparatus after the paper jam is removed.

3. An image forming apparatus comprising:

an image forming unit that forms at least one image on a sheet;

a double-sided sheet conveying path which the sheet passes when being conveyed back to said image forming unit again to form an image on an opposite side surface of the sheet after an image is formed on one side surface of the sheet;

a retaining member that is provided on said double-sided sheet conveying path to retain the sheet on said double-sided sheet conveying path;

a post-processing device that carries out post-processing on sheets on which images have been formed by said image forming unit;

a controller that controls conveyance of the sheet; and a conveying destination designating device that designates said double-sided sheet conveying path as a conveying destination of the sheet on which at least one image has been formed by said image forming unit when said post-processing device is carrying out post-processing, and designates said post-processing device as the conveying destination of the sheet on which at least one image has been formed by said image forming unit, when said post-processing device is not carrying out post-processing, wherein said controller provides control to convey the sheet on which the at least one image has been formed by said image forming unit to said double-sided sheet conveying path, cause said retaining member to temporarily retain the sheet on said double-sided sheet conveying path, and then convey the sheet to said post-processing device, wherein said controller provides control to convey the sheet on which at least one image has been formed by said image forming unit to the conveying destination designated by said conveying destination designating device, and wherein said controller is operable when a second sheet being conveyed to said post-processing device is jammed while a first sheet is retained on said double-sided sheet conveying path by said retaining member, to provide control to stop operation of the image forming apparatus while allowing the first sheet to be retained on said double-sided sheet conveying path, cause said image forming unit to form at least one image corresponding to the jammed second sheet on a third sheet when the operation of the image forming apparatus is restarted, and discharge the first sheet retained in said double-sided sheet conveying path after the third sheet on which at least one image has been formed by said image forming unit is discharged.

4. An image forming apparatus as claimed in claim 2, wherein when said controller stops the operation of the image forming apparatus while the sheet is retained on said double-sided sheet conveying path, said controller is operable when a cover which can come into contact with the sheet retained on said double-sided sheet conveying path is opened while the jammed sheet is removed, to provide control to issue an instruction requesting for removing the sheet retained in said double-sided sheet conveying path, cause said image forming unit to form at least one image corresponding to the removed sheet on a second sheet, and discharge the second sheet on which the at least one image has been formed.

5. An image forming apparatus as claimed in claim 3, wherein when said controller stops the operation of the image forming apparatus while the sheet is retained on said double-sided sheet conveying path, said controller is operable when a cover which can come into contact with the sheet retained on said double-sided sheet conveying path is opened while the jammed sheet is removed, to provide control to issue an instruction requesting for removing the sheet retained in said double-sided sheet conveying path, cause said image forming unit to form at least one image corresponding to the removed sheet on a second sheet, and discharge the second sheet on which the at least one image has been formed.

* * * * *